US009550370B2

(12) United States Patent
Suzuki et al.

(10) Patent No.: US 9,550,370 B2
(45) Date of Patent: Jan. 24, 2017

(54) PRINT DEVICE

(71) Applicant: Brother Kogyo Kabushiki Kaisha, Nagoya-shi, Aichi-ken (JP)

(72) Inventors: Yuichiro Suzuki, Komaki (JP); Yasutoshi Kano, Kariya (JP); Koshiro Yamaguchi, Kakamigahara (JP); Tomoyasu Fukui, Inuyama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/079,819

(22) Filed: Mar. 24, 2016

(65) Prior Publication Data

US 2016/0288529 A1 Oct. 6, 2016

(30) Foreign Application Priority Data

Mar. 31, 2015 (JP) ..... 2015-070980

(51) Int. Cl.
*B41J 2/325* (2006.01)
*B41J 11/48* (2006.01)
*B41J 3/407* (2006.01)

(52) U.S. Cl.
CPC ..... *B41J 2/325* (2013.01); *B41J 3/407* (2013.01); *B41J 11/48* (2013.01)

(58) Field of Classification Search
CPC ..... B41J 2/325; B41J 3/407; B41J 3/4075; B41J 3/44; B41J 2/54; B41J 3/543; B41J 3/546; B41J 3/62; B41J 11/48; B41J 11/52; B41J 13/042; B41J 15/044; B41J 15/22
See application file for complete search history.

(56) References Cited

U.S. PATENT DOCUMENTS

| | | | | |
|---|---|---|---|---|
| 4,747,707 A | | 5/1988 | Komori | |
| 5,529,407 A | * | 6/1996 | Ikeda | B41J 11/48 400/577 |
| 5,782,567 A | * | 7/1998 | Endo | B41J 11/48 400/611 |
| 6,168,324 B1 | | 1/2001 | Lever et al. | |
| 6,938,969 B2 | * | 9/2005 | Shibasaki | B41J 11/48 347/104 |

(Continued)

FOREIGN PATENT DOCUMENTS

| | | |
|---|---|---|
| JP | S62-109949 U | 7/1987 |
| JP | H09-290524 A | 11/1997 |

(Continued)

*Primary Examiner* — Anh T. N. Vo
(74) *Attorney, Agent, or Firm* — Banner & Witcoff, Ltd.

(57) ABSTRACT

A print device includes a tape mounting portion, a tape print portion, a tape discharge portion, a tube mounting portion, a ribbon mounting portion, a tube print portion, and a tube discharge portion. The tape mounting portion is configured such that a tape is detachably mounted in the tape mounting portion. The tube mounting portion is configured such that a tube is detachably mounted in the tube mounting portion along a predetermined direction. The ribbon mounting portion is configured such that an ink ribbon is detachably mounted in the ribbon mounting portion. The tape mounting portion and the ribbon mounting portion are disposed on a same side with respect to the tube mounting portion, and are disposed side by side along the predetermined direction.

14 Claims, 16 Drawing Sheets

(56) References Cited

U.S. PATENT DOCUMENTS

| | | | | |
|---|---|---|---|---|
| 7,275,881 | B2 * | 10/2007 | Block | B41J 3/54 400/149 |
| 7,354,148 | B2 * | 4/2008 | Oishi | B41J 11/0025 347/104 |
| 7,475,819 | B2 * | 1/2009 | Moriyama | B41J 3/4075 235/375 |
| 2010/0202816 | A1 | 8/2010 | Block et al. | |

FOREIGN PATENT DOCUMENTS

| | | | |
|---|---|---|---|
| JP | 2001-509102 | A | 7/2001 |
| JP | 2006-116969 | A | 5/2006 |

* cited by examiner

PRINT DEVICE

CROSS-REFERENCE TO RELATED APPLICATION

This application claims priority to Japanese Patent Application No. 2015-70980, filed Mar. 31, 2015. The disclosure of the foregoing application is incorporated herein by reference in its entirety.

BACKGROUND

The present disclosure relates to a print device that is provided with a plurality of printing mechanisms.

In related art, a print device is known that is configured to perform printing on a tube. Further, a print device is known that is provided with a plurality of printing mechanisms. For example, a print device is known in which two printing mechanisms are provided in a left and right arrangement. A print device is known in which two printing mechanisms are provided in an up and down arrangement. A print device is known in which two printing mechanisms are provided in a front and rear arrangement.

SUMMARY

In light of the above-described known print devices, a print device that is provided with a tube printing mechanism and a tape printing mechanism is conceivable. However, when the tube printing mechanism and the tape printing mechanism are simply arranged side by side, there is a possibility of an increase in size of the print device.

Various embodiments of the broad principles derived herein provide a print device that is configured to downsize the print device having a tube printing mechanism and a tape printing mechanism.

The embodiments herein provide a print device that includes a print device according to an aspect of the present invention includes a tape mounting portion, a tape print portion, a tape discharge portion, a tube mounting portion, a ribbon mounting portion, a tube print portion, and a tube discharge portion. The tape mounting portion is configured such that a tape is detachably mounted in the tape mounting portion. The tape is a strip-shaped print medium. The tape print portion is configured to print on the tape mounted in the tape mounting portion. The tape discharge portion is configured to discharge the tape printed by the tape print portion to the outside of the print device. The tube mounting portion is configured such that a tube is detachably mounted in the tube mounting portion along a predetermined direction. The tube is a cylindrical print medium. The ribbon mounting portion is configured such that an ink ribbon is detachably mounted in the ribbon mounting portion. The tube print portion is configured to print on the tube mounted in the tube mounting portion, using the ink ribbon mounted in the ribbon mounting portion. The tube discharge portion is configured to discharge the tube printed by the tube print portion to the outside of the print device. The tape mounting portion and the ribbon mounting portion are disposed on a same side with respect to the tube mounting portion, and are disposed side by side along the predetermined direction.

BRIEF DESCRIPTION OF THE DRAWINGS

Embodiments of the present disclosure will be described below in detail with reference to the accompanying drawings in which.

DETAILED DESCRIPTION

1. First Embodiment

1-1. Structural Description of Print Device 1

Figure 3:
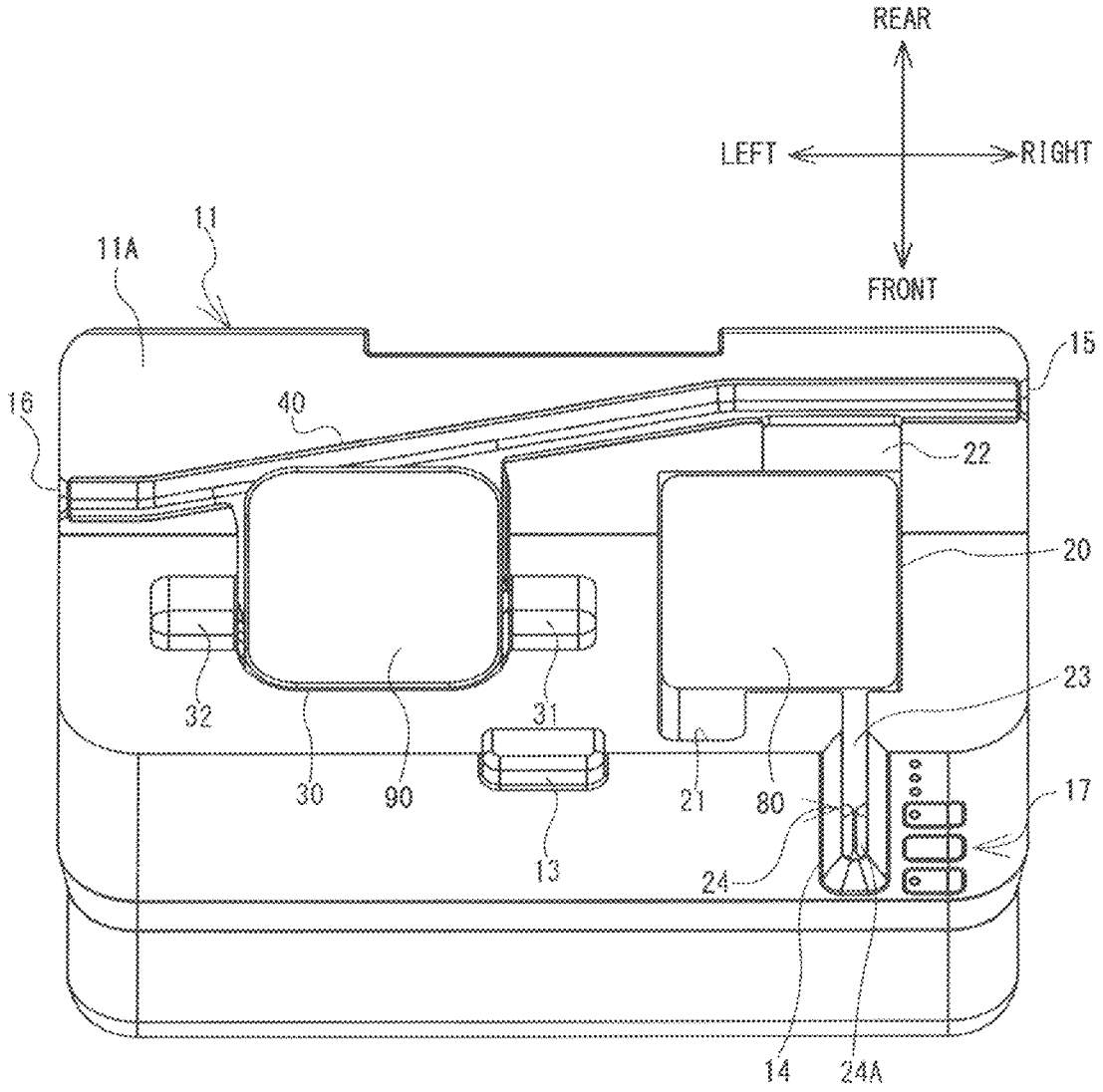
FIG. 3 is a perspective view of a main body case as viewed from the upper front side.
Figure 4:
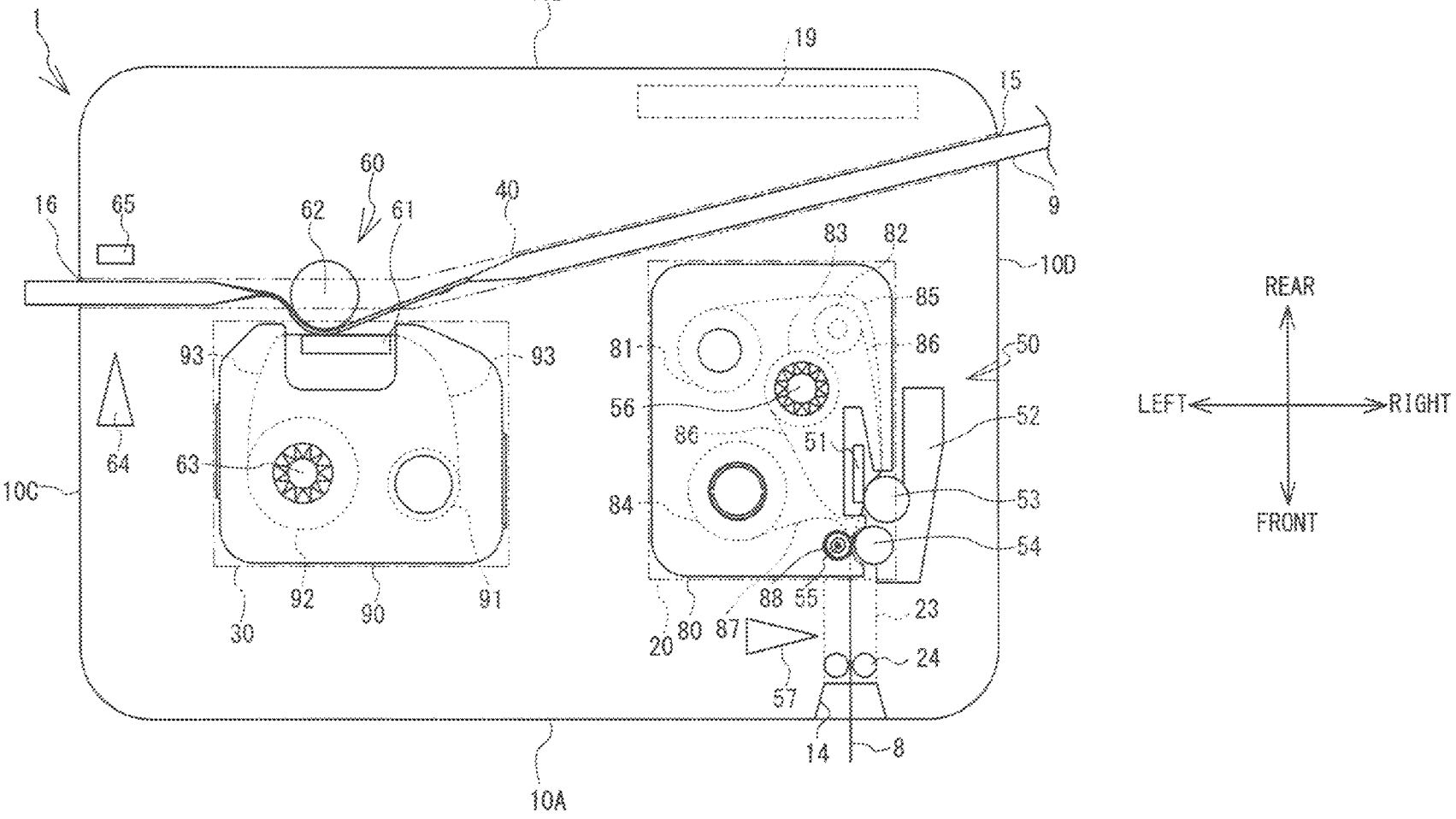
FIG. 4 is a plan view schematically showing an internal structure of the print device.

A first embodiment of the present disclosure will be described with reference to the drawings. A print device 1 according to the first embodiment will be described with reference to FIG. 1 to FIG. 4. In FIG. 3, a tape cassette 80 and a ribbon cassette 90 are schematically shown, and a tape printing mechanism 50 and a tube printing mechanism 60 are omitted. FIG. 4 shows a state in which the tape cassette 80, the ribbon cassette 90 and a tube 9 are respectively mounted in a tape mounting portion 20, a ribbon mounting portion 30 and a tube mounting portion 40 (this also applies to FIG. 5A to FIG. 5C and FIG. 6A to 6C, which will be described later). In the description below, the upper side, the lower side, the lower right side, the upper left side, the upper right side and the lower left side of FIG. 1 are respectively defined as the upper side, the lower side, the right side, the left side, the rear side and the front side of the print device 1.

Figure 1:
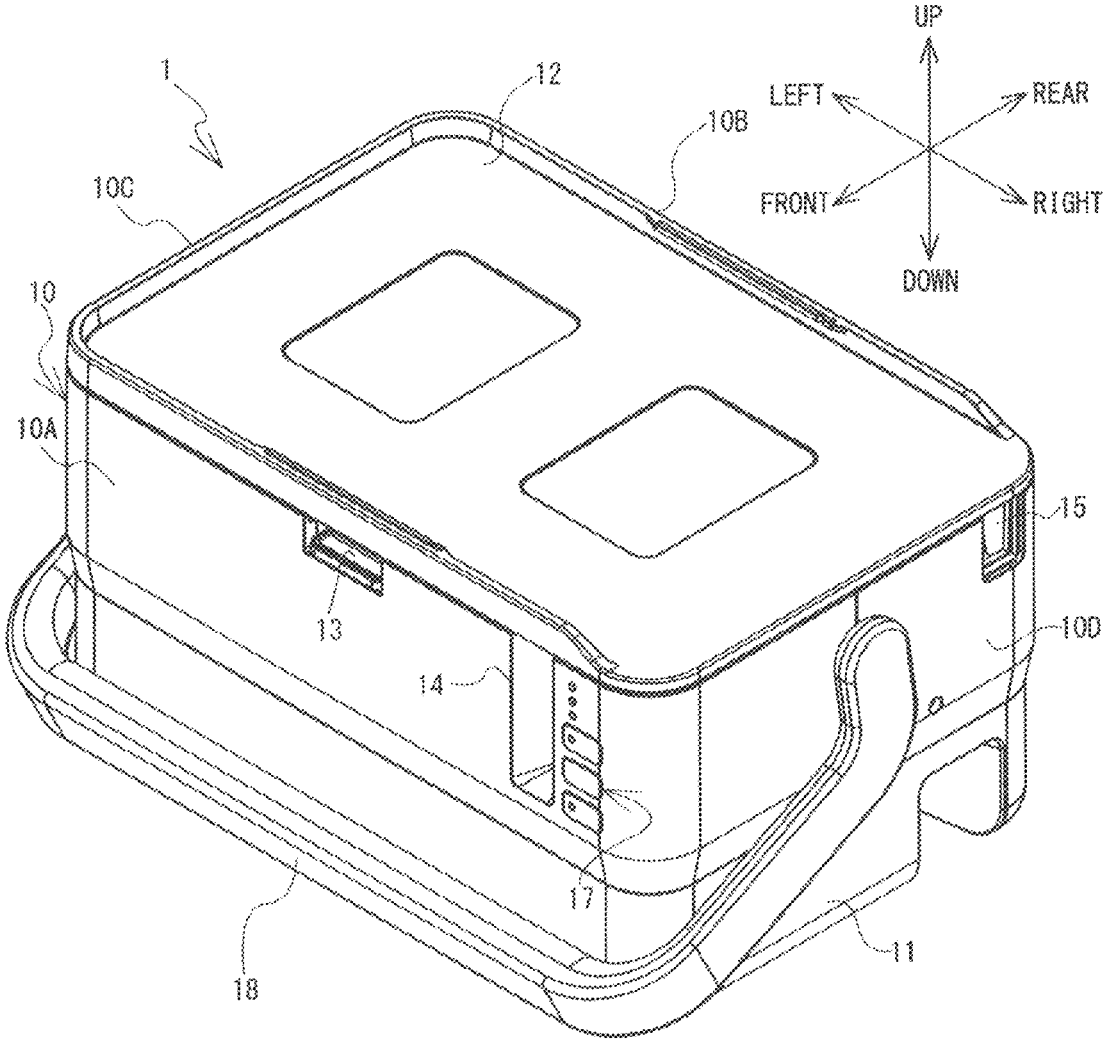
FIG. 1 is a perspective view of a print device as viewed from the upper right front side.
Figure 2:
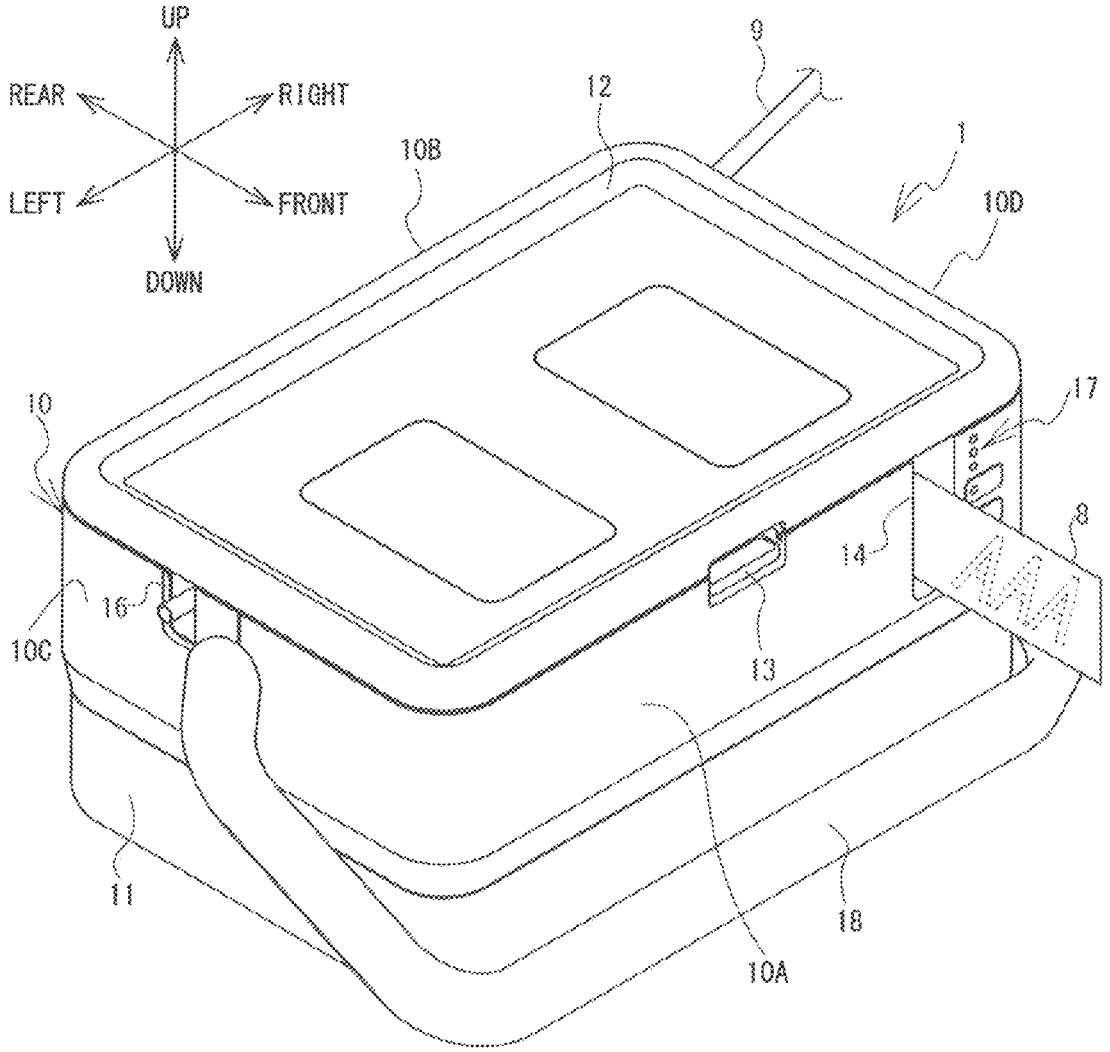
FIG. 2 is a perspective view of the print device as viewed from the upper left front side.

As shown in FIG. 1 and FIG. 2, the print device 1 is configured to print a tape 8, which is a strip-shaped print medium, and the tube 9, which is a cylindrical print medium, using the two printing mechanisms, respectively. The print device 1 is provided with a housing 10 that includes a main body case 11 and a cover 12. The housing 10 has a plurality of side surfaces, namely, a front surface 10A and a rear surface 10B that face each other in the front-rear direction, and a left surface 10C and a right surface 10D that face each other in the left-right direction.

The main body case 11 is a cuboid box-shaped member that is long in the left-right direction. The cover 12 is a plate-shaped member, and is disposed on the upper side of the main body case 11. A rear end portion of the cover 12 is rotatably supported by the upper side of a rear end portion of the main body case 11. A lock mechanism 13 is provided on the upper side of a front end portion of the main body case 11. The lock mechanism 13 locks a front end portion of the cover 12 that is closed with respect to the main body case 11, and restricts the opening of the cover 12.

When the cover 12 is closed with respect to the main body case 11 (refer to FIG. 1 and FIG. 2), the cover 12 covers a mounting surface 11A (refer to FIG. 3). The mounting surface 11A is a top surface of the main body case 11. When a user opens the cover 12, the user operates the lock mechanism 13 to release the locking of the cover 12, and causes the cover 12 to pivot upward from the lock mechanism 13. When the cover 12 is opened with respect to the main body case 11, the mounting surface 11A is exposed in the upward direction.

A tape discharge opening 14, a tube insertion opening 15, a tube discharge opening 16, a user interface portion 17 and a handle portion 18 are provided on the side surfaces of the housing 10. In the present example, the front surface 10A, the rear surface 10B, the left surface 10C and the right surface 10D substantially correspond to the front surface, the rear surface, the left surface and the right surface of the main body case 11. The tape discharge opening 14 is an opening to discharge the tape 8 to the outside of the housing 10. The tape discharge opening 14 is provided in an upper right portion of the front surface 10A, and has a rectangular shape that is long in the up-down direction.

The tube insertion opening 15 is an opening to guide the tube 9 to the inside of the housing 10. The tube insertion opening 15 is provided in an upper portion on the rear side of the right surface 10D, and has a rectangular shape that is slightly longer in the up-down direction. The tube discharge opening 16 is an opening to discharge the tube 9 to the outside of the housing 10. The tube discharge opening 16 is provided in an upper portion on the rear side of the left surface 10C, and has a rectangular shape that is slightly longer in the up-down direction. The tube discharge opening 16 is located slightly to the front of the tube insertion opening 15. The direction in which the tube 9 is discharged from the print device 1 is referred to as a tube discharge direction. The tube discharge direction is determined by an orientation of the tube discharge opening 16. Therefore, a manufacturer can change the tube discharge direction by a design change of the orientation of the tube discharge opening 16. In the present example, since the tube discharge opening 16 is directed leftward and substantially horizontally, the tube discharge direction is also a substantially horizontal and leftward direction.

The user interface portion 17 includes a display portion and an operation portion. In the present example, the display portion is a plurality of LEDs that indicate an operation state of the print device 1. The operation portion is a plurality of operation buttons including a power button and a start button. The user interface portion 17 is provided on the front surface 10A, to the right of the tape discharge opening 14. The handle portion 18 is a member that is gripped when the user carries the print device 1. The handle portion 18 is provided as a bridge between the left surface 10C and the right surface 10D, and can rotate to the front side and to the rear side while passing above the main body case 11.

As shown in FIG. 3, the tape mounting portion 20, the ribbon mounting portion 30, the tube mounting portion 40 and the like are provided in the mounting surface 11A. The tape mounting portion 20 is a portion which the tape cassette 80 can be attached to and detached from. The tape mounting portion 20 is a recessed portion that is open upward, and is formed in an open shape substantially corresponding to the tape cassette 80 in a plan view. The tape mounting portion 20 of the present example is provided in a right portion of the mounting surface 11A and in front of the tube mounting portion 40.

A relief portion 21 is a portion that is recessed forward from a front left portion of the tape mounting portion 20. A relief portion 22 is a portion that is recessed rearward from a rear right portion of the tape mounting portion 20. In a state in which the cover 12 (refer to FIG. 1) is open, the user can attach and detach the tape cassette 80 to and from the tape mounting portion 20 from above. At this time, the user can easily attach and detach the tape cassette 80 to and from the tape mounting portion 20, by inserting his/her fingers that are gripping the tape cassette 80 into the relief portions 21 and 22. In a state in which the tape cassette 80 is mounted in the tape mounting portion 20, the width direction of various tapes and of an ink ribbon housed in the tape cassette 80 is substantially parallel to the up-down direction.

A feed path 23 is a groove portion that extends continuously forward from a front right portion of the tape mounting portion 20. A front end portion of the feed path 23 is connected to the tape discharge opening 14. A tape guide 24 is provided in the feed path 23, on the rear side of the tape discharge opening 14. The tape guide 24 has a pair of discharge rollers 24A that are disposed to face each other in the left-right direction. Each of the discharge rollers 24A is a rotating body that is configured to rotate around an axial line that is orthogonal to the bottom surface of the housing 10. A gap through which the tape 8 (refer to FIG. 2) can pass is formed between the pair of discharge rollers 24A.

The direction in which the tape 8 is discharged from the print device 1 is referred to as a tape discharge direction. The tape discharge direction is determined by the direction in which the pair of discharge rollers 24A feed the tape 8. Therefore, the manufacturer can change the tape discharge direction by a design change of the direction in which the pair of discharge rollers 24A feed the tape 8. In the tape guide 24 of the present example, the pair of discharge rollers 24A rotate while clamping the tape 8 between them, and thus the tape 8 is fed forward and substantially horizontally. Therefore, the tape discharge direction is also a substantially horizontal and forward direction.

The ribbon mounting portion 30 is a portion which the ribbon cassette 90 can be attached to and detached from. The ribbon mounting portion 30 is a recessed portion that is open upward, and is formed in an open shape substantially corresponding to the ribbon cassette 90 in a plan view. The ribbon mounting portion 30 of the present example is provided in a left portion of the mounting surface 11A and in front of the tube mounting portion 40. In other words, the tape mounting portion 20 and the ribbon mounting portion 30 are disposed along a tube feed direction that will be described later, such that they are arranged side by side in the left-right direction. In the present example, substantially the whole of the tape mounting portion 20 overlaps with substantially the whole of the ribbon mounting portion 30 in the left-right direction.

A relief portion 31 is a portion that is recessed rightward from a front right portion of the ribbon mounting portion 30. A relief portion 32 is a portion that is recessed leftward from a front left portion of the ribbon mounting portion 30. In a state in which the cover 12 is open, the user can attach and detach the ribbon cassette 90 to and from the ribbon mounting portion 30 from above. At this time, the user can easily attach and detach the ribbon cassette 90 to and from the ribbon mounting portion 30, by inserting his/her fingers that are gripping the ribbon cassette 90 into the relief portions 31 and 32.

The tube mounting portion 40 is a portion which the tube 9 (refer to FIG. 2) can be attached to and detached from. The tube mounting portion 40 is a groove portion that is open upward, and extends from the tube insertion opening 15 to the tube discharge opening 16. Since the tube discharge opening 16 is located slightly to the front of the tube insertion opening 15, the tube mounting portion 40 is slightly inclined toward the front left side and extends substantially in the left-right direction. The direction in which the tube mounting portion 40 extends from the tube insertion opening 15 toward the tube discharge opening 16 is referred to as the tube feed direction. A cross section of the opening of the tube mounting portion 40 that is orthogonal to the tube feed direction is slightly larger than a cross section (namely, a transverse section of the tube 9) that is orthogonal to the extending direction of the tube 9, except a section where the tube mounting portion 40 and the ribbon mounting portion 30 are connected spatially.

A rear end portion of the relief portion 22 is connected spatially to the tube mounting portion 40 on the left side of the tube insertion opening 15. A rear end portion of the ribbon mounting portion 30 is connected spatially to the tube mounting portion 40 on the right side of the tube discharge opening 16. In a state in which the cover 12 is open, the user can attach and detach the tube 9 to and from the tube mounting portion 40 from above. At this time, the user can easily attach and detach the tube 9 to and from the tube mounting portion 40, by inserting his/her fingers that are gripping the tube 9 into at least one of the relief portion 22 and the ribbon mounting portion 30. The user mounts the tube 9 in the tube mounting portion 40 along the tube feed direction such that the tube 9 extends from the tube insertion opening 15 to the tube discharge opening 16.

A control board 19, a power source portion (not shown in the drawings), the tape printing mechanism 50, the tube printing mechanism 60, the tape cassette 80 and the ribbon cassette 90 will be described with reference to FIG. 4. The control board 19 is a board on which a CPU, a ROM, a RAM, a CGROM and the like (which are not shown in the drawings) are provided, and controls various operations of the print device 1. For example, the control board 19 controls a printing operation of each of the tape printing mechanism 50 and the tube printing mechanism 60. The control board 19 of the present example is provided on a rear right portion inside the main body case 11 (refer to FIG. 3), and extends in the up-down direction and the left-right direction. The power source portion is connected to a battery (not shown in the drawings) that is mounted in the main body case 11, or is connected to an external power source (not shown in the drawings) via a cord, and supplies power to the print device 1. The power source portion of the present example is provided on the front side of the control board 19.

The tape cassette 80 is a box-shaped body that is configured to house at least the tape 8. The tape cassette 80 of the present example is a laminate type tape cassette that houses a film tape 85 and a double-sided adhesive tape 87, as the tape 8, and also houses an ink ribbon 86. A first tape roll 81, a ribbon roll 82, a ribbon take-up spool 83, a second tape roll 84 and a tape drive roller 88 are each rotatably supported inside the tape cassette 80.

The first tape roll 81 is the unused film tape 85 wound around a spool (not shown in the drawings). The ribbon roll 82 is the unused ink ribbon 86 wound around a spool (not shown in the drawings). The ribbon take-up spool 83 is a spool around which the used ink ribbon 86 is wound. The second tape roll 84 is the unused double-sided adhesive tape 87 wound around a spool (not shown in the drawings). The tape drive roller 88 is a roller to feed the tape 8.

The tape printing mechanism 50 includes a print head 51, a platen holder 52, a platen roller 53, a movable feed roller 54, a tape drive shaft 55, a ribbon take-up shaft 56, a cutter 57, a first drive motor (not shown in the drawings), a cutter motor (not shown in the drawings), a second drive motor (not shown in the drawings) and the like. The print head 51, the tape drive shaft 55 and the ribbon take-up spool 56 are each provided so as to stand upward from the bottom surface of the tape mounting portion 20. The print head 51 is a thermal head that includes a heating body (not shown in the drawings), and is provided on the front right portion of the tape mounting portion 20. The tape drive shaft 55 is a shaft that can rotate the tape drive roller 88. The ribbon take-up shaft 56 is a shaft that is configured to rotate the ribbon take-up spool 83. The first drive motor (not shown in the drawings) is a motor that drives and rotates the tape drive shaft 55 and the ribbon take-up shaft 56.

The platen roller 53 is a roller that is configured to rotate relative to the print head 51. The movable feed roller 54 is a roller that is configured to rotate relative to the tape drive shaft 55. The platen roller 53 and the movable feed roller 54 are rotatably supported at the leading end of the platen holder 52. The platen holder 52 is disposed on the right side of the tape mounting portion 20, and is configured to be displaced between an operating position and a retracted position in accordance with the opening and closing of the cover 12 (refer to FIG. 1). When the platen holder 52 is in the operating position, the platen roller 53 and the movable feed roller 54 are disposed on the inside of the tape mounting portion 20. When the platen holder 52 is in the retracted position, the platen roller 53 and the movable feed roller 54 are disposed on the outside of the tape mounting portion 20. The cutter 57 is provided to the rear of the tape guide 24, and is configured to cut the tape 8 on the feed path 23. The cutter motor (not shown in the drawings) is a motor that drives the cutter 57. The second drive motor (not shown in the drawings) is a motor that drives and rotates the tape guide 24.

When the cover 12 (refer to FIG. 1) is opened, the platen holder 52 is displaced to the retracted position. When the tape cassette 80 is mounted in the tape mounting portion 20, the tape drive shaft 55 and the ribbon take-up shaft 56 are respectively inserted into the tape drive roller 88 and the ribbon take-up spool 83. After that, when the cover 12 is closed, the platen holder 52 is displaced to the operating position. The platen roller 53 causes the unused film tape 85 and the unused ink ribbon 86 to be superimposed with each other, and urges them toward the print head 51. The printed film tape 85 and the unused double-sided adhesive tape 87 are clamped between the movable feed roller 54 and the tape drive roller 88.

The tape printing mechanism 50 performs the following printing operations in accordance with control of the control board 19. The first drive motor of the tape printing mechanism 50 rotates the tape drive shaft 55 and the ribbon take-up shaft 56, and thereby rotates the tape drive roller 88 and the ribbon take-up spool 83. In accordance with the rotation of the tape drive roller 88, the film tape 85 is pulled out from the first tape roll 81, and the double-sided adhesive tape 87 is pulled out from the second tape roll 84. In accordance with the rotation of the ribbon take-up spool 83, the ink ribbon 86 is pulled out from the ribbon roll 82. The film tape 85 and the ink ribbon 86 that have been pulled out are fed to a position between the print head 51 and the platen roller 53.

Using the ink ribbon 86, the print head 51 performs mirror image printing and prints characters on the film tape 85. The print head 51 of the present example prints characters on the left surface of the film tape 85 that passes through the right side of the print head 51. The used ink ribbon 86 is taken up by the ribbon take-up spool 83. The printed film tape 85 is fed to a position between the movable feed roller 54 and the tape drive roller 88, and the pulled out double-sided adhesive tape 87 is adhered to the printed film tape 85. In this manner, the tape 8 obtained by adhering the double-sided adhesive tape 87 to a print surface of the film tape 85 is created. In the created tape 8, the characters appear on a surface on the opposite side to the print surface of the film tape 85. Hereinafter, of both the surfaces of the tape 8, the surface on which the characters appear (in the present example, the surface to which the double-sided adhesive tape 87 is not adhered) is referred to as a print surface of the tape 8.

Further, the tape 8 passes through the inside of the feed path 23, and is fed forward as far as the tape guide 24. The second drive motor of the tape printing mechanism 50 rotates and drives the tape guide 24, and further feeds the tape 8 forward. The fed tape 8 is discharged from the tape discharge opening 14 in a posture in which the width direction of the tape 8 is substantially parallel to the up-down direction. At this time, the tape 8 is discharged forward from the front surface 10A such that the print surface of the tape 8 is directed rightward. The cutter motor of the tape printing mechanism 50 drives the cutter 57, and cuts the tape 8 behind the tape guide 24. The cut tape 8 (a so-called label) is caused to fly forward from the tape discharge opening 14 by a distance corresponding to a rotation speed of the tape guide 24 (more specifically, the pair of discharge rollers 24A), and falls into a first discharge area (not shown in the drawings). The first discharge area is an area in which the tape 8 discharged by the tape guide 24 is arranged outside the housing 10.

The ribbon cassette 90 is a box-shaped body that is configured to house an ink ribbon 93. A ribbon roll 91 and a ribbon take-up spool 92 are each rotatably supported inside the ribbon cassette 90. The ribbon roll 91 is the unused ink ribbon 93 wound around a spool (not shown in the drawings). The ribbon take-up spool 92 is a spool around which the used ink ribbon 93 is wound.

The tube printing mechanism 60 includes a print head 61, a movable feed roller 62, a ribbon take-up shaft 63, a cutter 64, a cutting board 65, a drive motor (not shown in the drawings), a cutter motor (not shown in the drawings) and the like. The print head 61 and the ribbon take-up shaft 63 are each provided so as to stand upward from the bottom surface of the ribbon mounting portion 30. The print head 61 is a thermal head that includes a heating body (not shown in the drawings), and is provided on a rear portion of the ribbon mounting portion 30. The ribbon take-up shaft 63 is a shaft that is configured to rotate the ribbon take-up spool 92.

The movable feed roller 62 is a roller that is configured to rotate relative to the print head 61. The movable feed roller 62 is disposed on the rear side of the ribbon mounting portion 30, and is configured to be displaced between an operating position and a retracted position in accordance with the opening and closing of the cover 12 (refer to FIG. 1). When the movable feed roller 62 is in the operating position, the movable feed roller 62 is disposed on the inside of the tube mounting portion 40 and comes close to the print head 61. When the movable feed roller 62 is in the retracted position, the movable feed roller 62 is disposed on the rear side of the tube mounting portion 40, and is separated from the print head 61. The drive motor (not shown in the drawings) is a motor that drives and rotates the movable feed roller 62 and the ribbon take-up shaft 63.

The cutter 64 and the cutting board 65 are provided on the upstream side in the tube feed direction relative to the tube discharge opening 16, and on the downstream side in the tube feed direction relative to the ribbon mounting portion 30. The cutter 64 and the cutting board 65 are provided so as to face each other, with the tube mounting portion 40 interposed therebetween. By the cutter 64 moving toward the cutting board 65, the cutter 64 can press the tube 9 located in the tube mounting portion 40 against the cutting board 65 and can cut the tube 9. The cutter motor (not shown in the drawings) is a motor that drives the cutter 64.

When the cover 12 is opened, the movable feed roller 62 is displaced to the retracted position. When the ribbon cassette 90 is mounted in the ribbon mounting portion 30, the ribbon take-up shaft 63 is inserted into the ribbon take-up spool 92. After that, when the cover 12 is closed, the movable feed roller 62 is displaced to the operating position. The movable feed roller 62 causes the tube 9 located in the tube mounting portion 40 and the unused ink ribbon 93 to be superimposed with each other, and urges them toward the print head 61. At this time, the tube 9 is elastically deformed by the urging force of the movable feed roller 62, and comes into surface-contact with the print head 61 via the ink ribbon 93.

The tube printing mechanism 60 performs the following printing operations in accordance with the control of the control board 19. The drive motor of the tube printing mechanism 60 rotates the movable feed roller 62 and the ribbon take-up shaft 63. In accordance with the rotation of the movable feed roller 62, the tube 9 located in the tube mounting portion 40 is fed to the downstream side in the tube feed direction. At this time, the tube 9 before printing that is located outside the housing 10 is drawn into the inside of the tube mounting portion 40 from the right surface 10D via the tube insertion opening 15. The ribbon take-up spool 92 rotates in accordance with the rotation of the ribbon take-up shaft 63, and thus the ink ribbon 93 is pulled out from the ribbon roll 91.

Using the ink ribbon 93 that has been pulled out, the print head 61 prints characters on the tube 9 that is being fed. The print head 61 of the present example performs normal image printing and prints the characters on the front surface of the tube 9 that passes through the rear side of the print head 61. Therefore, the front surface of the tube 9 is the print surface of the tube 9. The used ink ribbon 93 is taken up by the ribbon take-up spool 92. The tube 9 after printing is fed from the movable feed roller 62 to the downstream side in the tube feed direction, and is discharged from the main body case 11 via the tube discharge opening 16. At this time, the tube 9 is discharged leftward from the left surface 10C such that the print surface of the tube 9 is directed forward.

The cutter motor of the tube printing mechanism 60 drives the cutter 64 and cuts the tube 9 on the upstream side in the tube feed direction relative to the tube discharge opening 16. The cut tube 9 is caused to fly leftward from the tube discharge opening 16 by a distance corresponding to a rotation speed of the movable feed roller 62, and falls into a second discharge area (not shown in the drawings). The second discharge area is an area in which the tube 9 discharged by the tube discharge opening 16 is arranged outside the housing 10. A front left wall of the main body case 11 is disposed between the first discharge area and the second discharge area. The front left wall of the main body case 11 forms a left portion of the front surface 10A and a front portion of the left surface 10C, which are a part of the side walls of the main body case 11.

In this manner, the tape guide 24 and the tube discharge opening 16 respectively discharge the tape 8 and the tube 9 to the outside of the housing 10 from positions that do not overlap with each other in the up-down direction (namely, from different positions in a plan view). A first direction that is a direction in which the tape guide 24 discharges the tape 8, and a second direction that is a direction in which the tube discharge opening 16 discharges the tube 9 are directions that separate from each other. In the present example, the first direction is a forward direction that is parallel to the horizontal direction, and the second direction is a leftward direction that is parallel to the horizontal direction. Therefore, an angle (more specifically, the minor angle) formed by the first direction and the second direction is approximately 90 degrees.

1-2. Structural Description of Print Devices According to Modified Examples

The present disclosure is not limited to the structure exemplified by the print device 1 (refer to FIG. 1 to FIG. 4), and various modifications are possible. Print devices 2 to 7 according to modified examples will be described with reference to FIG. 5A to FIG. 5C and FIG. 6A to FIG. 6C. In the description below, structural elements corresponding to those of the print device 1 are denoted by the same reference numerals and a description thereof will be omitted, and points that are different from the print device 1 will be mainly described.

Figure 5A:
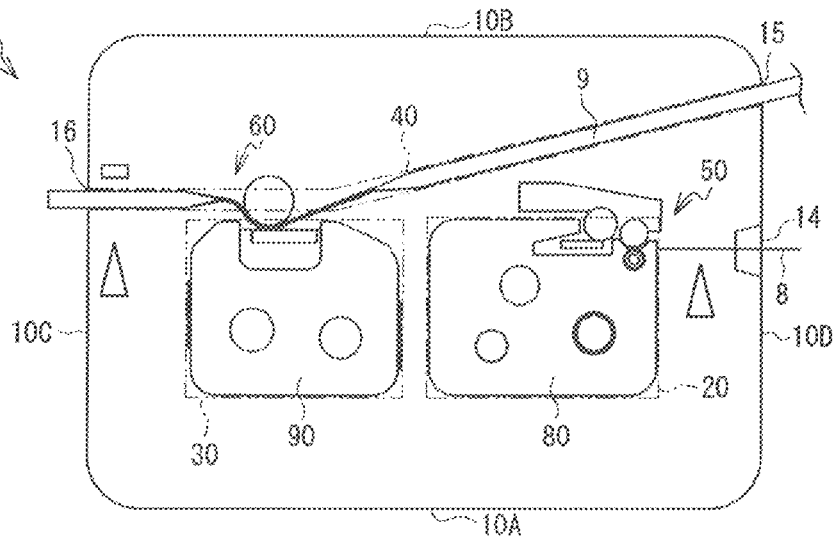
FIG. 5A to FIG. 5C are plan views respectively, schematically showing internal structures of print devices.

The print device 2 will be described with reference to FIG. 5A. The tape discharge opening 14 is provided at the center of an upper portion of the right surface 10D. In comparison to the arrangement of each of the tape mounting portion 20 and the tape printing mechanism 50 shown in FIG. 4, the tape mounting portion 20 and the tape printing mechanism 50 are rotated counterclockwise by 90 degrees around a substantial center of a right portion of the main body case 11 (refer to FIG. 3) in a plan view. The feed path 23 (refer to FIG. 3) extends to the right from the tape mounting portion 20, and connects to the tape discharge opening 14. The other structural elements are the same as those of the print device 1.

In the print device 2, the printed tape 8 is discharged via the tape discharge opening 14. At this time, the tape 8 is discharged rightward from a central portion in the front-rear direction of the right surface 10D, in a posture in which the print surface of the tape 8 is directed rearward. The tube 9 before printing is guided from a rear portion of the right surface 10D to the inside of the tube mounting portion 40 via the tube insertion opening 15. The tube 9 after printing is discharged via the tube discharge opening 16. At this time, the tube 9 is discharged leftward from a rear portion of the left surface 10C in a posture in which the print surface of the tube 9 is directed forward. The first discharge area and the second discharge area are provided on the right side and the left side, respectively, with the main body case 11 interposed therebetween.

Figure 5B:
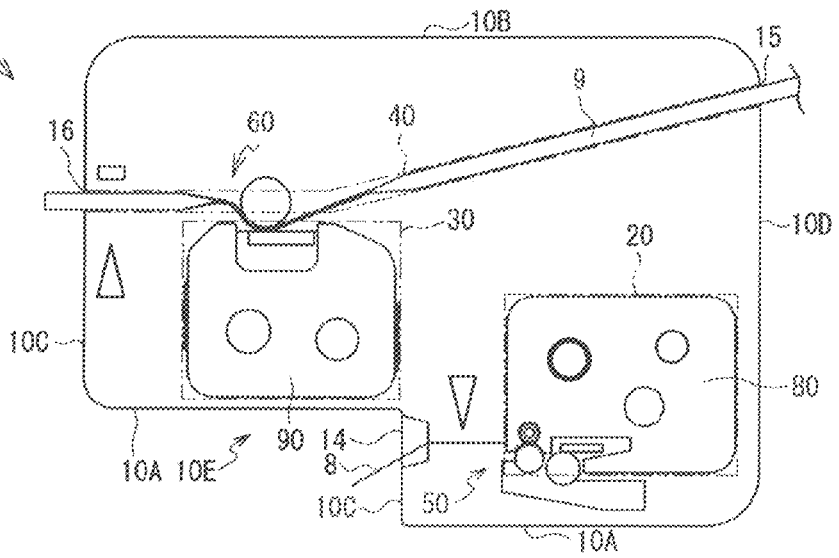

The print device 3 will be described with reference to FIG. 5B. A front left portion of the housing 10 (refer to FIG. 1) is recessed rearward relative to a front right portion of the housing 10. A step portion 10E is formed on the left side of the front right portion of the housing 10. The step portion 10E includes a front portion of the left surface 10C and a left portion of the front surface 10A. The tape discharge opening 14 is provided in an upper portion on the front side of the left surface 10C. In comparison to the arrangement of each of the tape mounting portion 20 and the tape printing mechanism 50 shown in FIG. 4, the tape mounting portion 20 and the tape printing mechanism 50 are rotated clockwise by 90 degrees around the substantial center of the right portion of the main body case 11 in a plan view. Further, the tape mounting portion 20 and the tape printing mechanism 50 are provided in a front right portion of the main body case 11. The feed path 23 extends to the left from the tape mounting portion 20, and connects to the tape discharge opening 14. The tape guide 24 (refer to FIG. 3) establishes the tape feed direction to the front left side. The other structural elements are the same as those of the print device 1.

In the print device 3, the printed tape 8 is discharged via the tape discharge opening 14. At this time, the tape 8 is discharged to the front left from the front portion of the left surface 10C in a posture in which the print surface of the tape 8 is directed forward. The tube 9 before printing is guided from the rear portion of the right surface 10D to the inside of the tube mounting portion 40 via the tube insertion opening 15. The tube 9 after printing is discharged via the tube discharge opening 16. At this time, the tube 9 is discharged leftward from the rear portion of the left surface 10C in the posture in which the print surface of the tube 9 is directed forward. The first discharge area and the second discharge area are both provided on the left side of the housing 10. However, the second discharge area is located to the rear of the first discharge area, and is located to the left of the first discharge area.

Figure 5C:
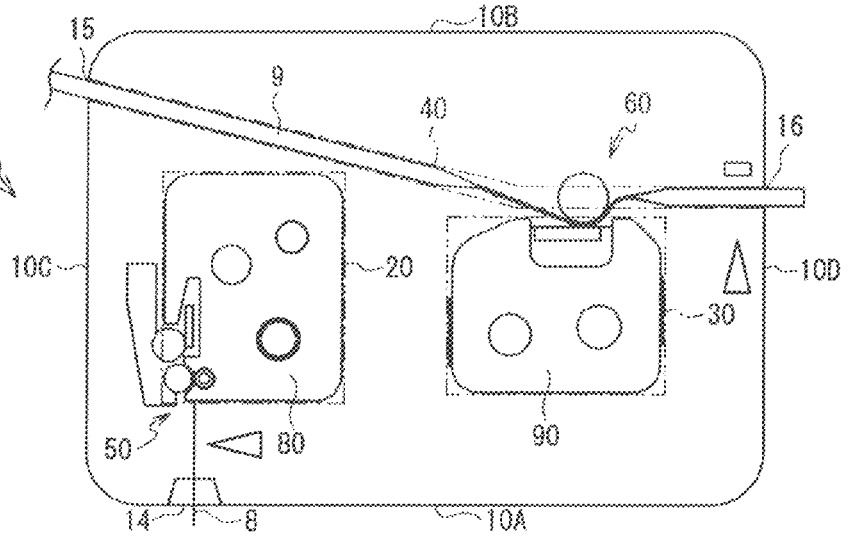

The print device 4 will be described with reference to FIG. 5C. The tape discharge opening 14 is provided in an upper left portion of the front surface 10A. The tube insertion opening 15 is provided in an upper portion on the rear side of the left surface 10C. The tube discharge opening 16 is provided in an upper portion on the rear side of the right surface 10D. The tube discharge opening 16 is slightly to the front of the tube insertion opening 15. In comparison to the arrangement of each of the tape mounting portion 20 and the tape printing mechanism 50 shown in FIG. 4, the tape mounting portion 20 and the tape printing mechanism 50 are left-right inverted with respect to a virtual line that extends in the front-rear direction and that passes through substantially the center of the main body case 11 in a plan view. The feed path 23 extends forward from the tape mounting portion 20, and connects to the tape discharge opening 14.

In comparison to the arrangement of each of the ribbon mounting portion 30, the tube mounting portion 40 and the tube printing mechanism 60 shown in FIG. 4, the ribbon mounting portion 30, the tube mounting portion 40 and the tube printing mechanism 60 are left-right inverted with respect to the virtual line that extends in the front-rear direction and that passes through substantially the center of the main body case 11 in a plan view. Both end portions, in the tube feed direction, of the tube mounting portion 40 connect to the tube insertion opening 15 and the tube discharge opening 16, respectively. The other structural elements are the same as those of the print device 1.

In the print device 4, the printed tape 8 is discharged via the tape discharge opening 14. At this time, the tape 8 is discharged forward from the left portion of the front surface 10A in a posture in which the print surface of the tape 8 is directed leftward. The tube 9 before printing is guided from the rear portion of the left surface 10C to the inside of the tube mounting portion 40 via the tube insertion opening 15. The tube 9 after printing is discharged via the tube discharge opening 16. At this time, the tube 9 is discharged rightward from the rear portion of the right surface 10D in the posture in which the print surface of the tube 9 is directed forward. The first discharge area and the second discharge area are respectively provided on the front side and the right side of the housing 10. A front right wall of the main body case 11 is disposed between the first discharge area and the second discharge area. The front right wall of the main body case 11 forms a right portion of the front surface 10A and a front portion of the right surface 10D, which are a part of the side walls of the main body case 11.

Figure 6A:
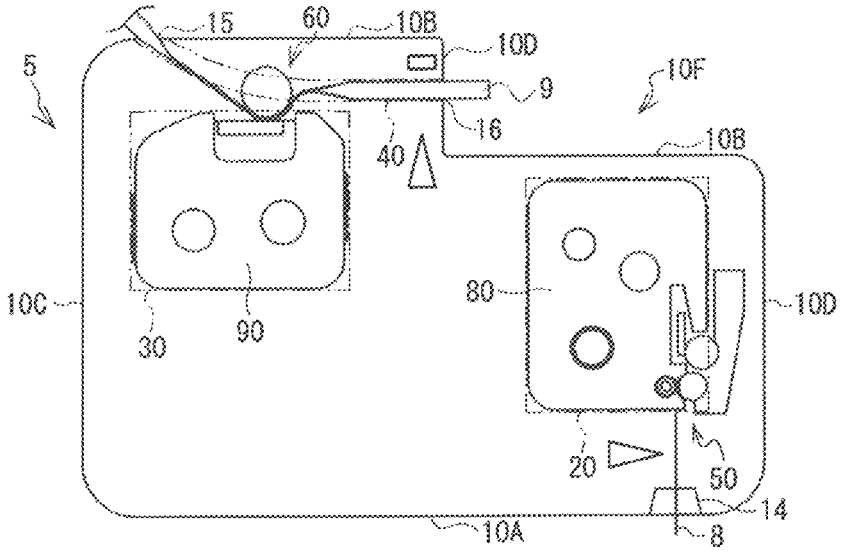
FIG. 6A to FIG. 6C are plan views respectively, schematically showing internal structures of print devices.

The print device 5 will be described with reference to FIG. 6A. A rear right portion of the housing 10 is recessed forward relative to a rear left portion of the housing 10. A step portion 10F is formed on the right side of the rear left portion of the housing 10. The step portion 10F includes a rear portion of the right surface 10D and a right portion of the rear surface 10B. The tube insertion opening 15 is provided in an upper left portion of the rear surface 10B. The tube discharge opening 16 is provided in an upper portion on the rear side of the right surface 10D. The ribbon mounting portion 30, the tube mounting portion 40 and the tube printing mechanism 60 are provided on a rear left portion of the main body case 11. Both end portions, in the tube feed direction, of the tube mounting portion 40 connect to the tube insertion opening 15 and the tube discharge opening 16, respectively. The other structural elements are the same as those of the print device 1.

In the print device 5, the printed tape 8 is discharged via the tape discharge opening 14. At this time, the tape 8 is discharged forward from a right portion of the front surface 10A in a posture in which the print surface of the tape 8 is directed rightward. The tube 9 before printing is guided from a left portion of the rear surface 10B to the inside of the tube mounting portion 40 via the tube insertion opening 15. The tube 9 after printing is discharged via the tube discharge opening 16. At this time, the tube 9 is discharged rightward from the rear portion of the right surface 10D in the posture in which the print surface of the tube 9 is directed forward. The first discharge area and the second discharge area are provided on the front side and the rear side of the housing 10, respectively, with the main body case 11 interposed therebetween.

Figure 6B:
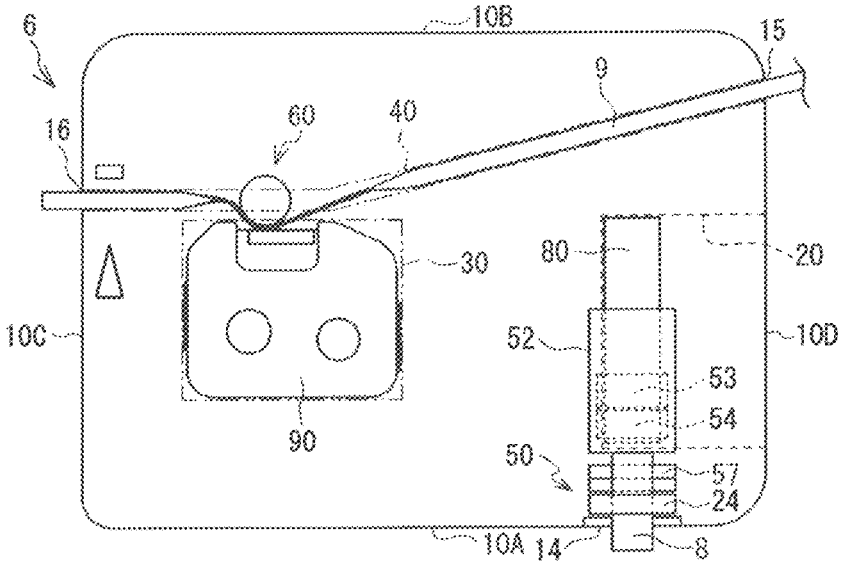

The print device 6 will be described with reference to FIG. 6B. The tape discharge opening 14 is rotated counterclockwise by 90 degrees in a front view in comparison to the arrangement shown in FIG. 4, and is provided in an upper right portion of the front surface 10A. That is, the tape discharge opening 14 has a rectangular shape that is long in the left-right direction. The tape mounting portion 20 and the tape printing mechanism 50 are rotated counterclockwise by 90 degrees around the substantial center of the right portion of the main body case 11 in a front view. The feed path 23 extends forward from the tape mounting portion 20, and connects to the tape discharge opening 14. The tape mounting portion 20 is a recessed portion that is recessed leftward from the right surface 10D and that is open to the right. Therefore, the tape cassette 80 can be attached to and detached from the tape mounting portion 20 from the right side. In the present example, in the state in which the tape cassette 80 is mounted in the tape mounting portion 20, the width direction of various tapes and of an ink ribbon housed in the tape cassette 80 is substantially parallel to the left-right direction. The other structural elements are the same as those of the print device 1.

In the print device 6, the printed tape 8 is discharged forward from a right portion of the front surface 10A via the tape discharge opening 14. The width direction of the discharged tape 8 is substantially parallel to the left-right direction. The print surface of the discharged tape 8 is directed upward. The tube 9 before printing is guided from a rear portion of the right surface 10D to the inside of the tube mounting portion 40 via the tube insertion opening 15. The tube 9 after printing is discharged via the tube discharge opening 16. At this time, the tube 9 is discharged leftward from a rear portion of the left surface 10C in the posture in which the print surface of the tube 9 is directed forward. The front left wall of the main body case 11 is disposed between the first discharge area and the second discharge area.

Figure 6C:
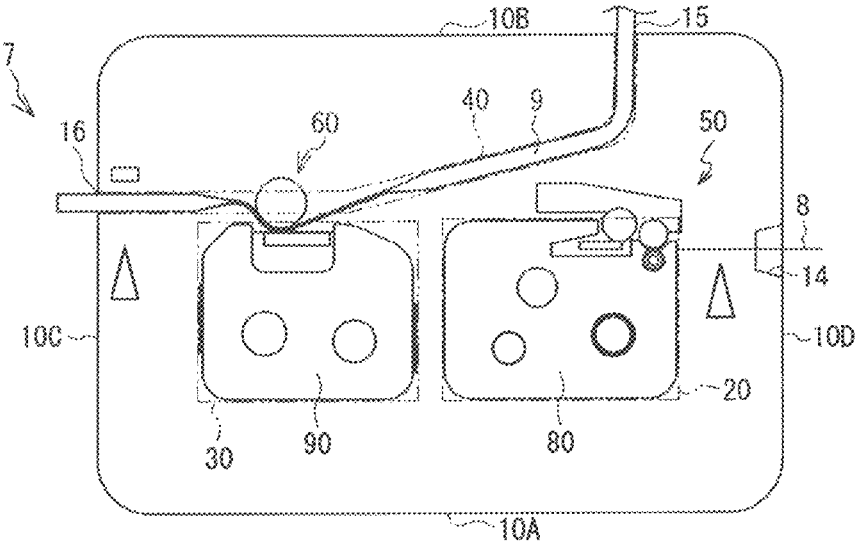

The print device 7 will be described with reference to FIG. 6C. The tube insertion opening 15 is provided in an upper right portion of the rear surface 10B. An end portion on the upstream side in the tube feed direction of the tube mounting portion 40 connects to the tube insertion opening 15. The other structural elements are the same as those of the print device 2 shown in FIG. 5A.

In the print device 7, the printed tape 8 is discharged via the tape discharge opening 14. At this time, the tape 8 is discharged rightward from a central portion in the front-rear direction of the right surface 10D in the posture in which the print surface of the tape 8 is directed rearward. The tube 9 before printing is guided from a right portion of the rear surface 10B to the inside of the tube mounting portion 40 via the tube insertion opening 15. The tube 9 after printing is discharged via the tube discharge opening 16. At this time, the tube 9 is discharged leftward from a rear portion of the left surface 10C in the posture in which the print surface of the tube 9 is directed forward. The first discharge area and the second discharge area are provided on the right side and left side of the housing 10, respectively, with the main body case 11 interposed therebetween.

As shown in FIG. 5A to FIG. 5C and FIG. 6A to FIG. 6C, in each of the print devices 2 to 7, the tape guide 24 (refer to FIG. 3) and the tube discharge opening 16 respectively discharge the tape 8 and the tube 9 in directions in which the tape 8 and the tube 9 move away from each other, from positions that do not overlap with each other in the up-down direction. In each of the print devices 2 to 4, 6 and 7, the tape mounting portion 20 and the ribbon mounting portion 30 are provided on the front side with respect to the tube mounting portion 40, and are arranged side by side along the tube feed direction. At least a part of the tape mounting portion 20 and at least a part of the ribbon mounting portion 30 are arranged side by side in the left-right direction. The arrangement of the tape mounting portion 20, the ribbon mounting portion 30, the tube mounting portion 40 and the like is not limited to that in the print devices 1 to 7, and may be changed as appropriate.

1-3. First Example of Functions According to First Embodiment

A first example of functions according to the first embodiment will be described.

(1-3-1) A print device is provided with a first print portion, a first discharge portion, a second print portion, and a second discharge portion. The first print portion is configured to print on a first medium. The first discharge portion is configured to discharge the first medium printed by the first print portion in a first direction to the outside of the print device. The second print portion is configured to print on a second medium. The second discharge portion is configured to discharge the second medium printed by the second print portion in a second direction to the outside of the print device. The first discharge portion and the second discharge portion are configured to respectively discharge the first medium and the second medium to the outside of the print device, from discharge positions that do not overlap with each other in the up-down direction. The first direction and the second direction are directions that separate from each other.

According to this, the first discharge portion and the second discharge portion discharge the first medium and the second medium in directions that separate from each other, from positions that do not overlap in the up-down direction. The discharged first medium and the discharged second medium are unlikely to become mixed outside the print device. Therefore, it may be possible to inhibit the print media respectively discharged from two printing mechanisms from becoming mixed, without increasing the size of the print device.

(1-3-2) In the print device, the first direction and the second direction are the horizontal direction. An angle (the minor angle) formed by the first direction and the second direction is 30 degrees or more.

According to this, the first medium and the second medium are discharged horizontally in directions differing by an angle of 30 degrees or more. Therefore, the first medium and the second medium move to positions that are further separated from each other. Therefore, the discharged first medium and the discharged second medium are unlikely to become mixed outside the print device.

(1-3-3) The print device is provided with a plurality of side surfaces. Each of the plurality of side surfaces is substantially parallel to the up-down direction. The first discharge portion is configured to discharge the first medium from a first position. The first position is one of the discharge positions and disposed in a first side surface included in the plurality of side surfaces. The second discharge portion is configured to discharge the second medium from a second position. The second position is another one of the discharge positions and disposed in a second side surface included in the plurality of side surfaces. The first side surface and the second side surface are adjacent to each other. The first position is located in a portion constituting a half of the first side surface. The portion constituting the half of the first side surface is on an opposite side to the second side surface. The second position is located in a portion constituting a half of the second side surface. The portion constituting the half of the second side surface is on an opposite side to the first side surface.

According to this, the first medium and the second medium are discharged from the two side surfaces that are adjacent to each other, and are discharged from positions that are most distant from each other. Therefore, the discharged first medium and the discharged second medium are unlikely to become mixed outside the print device.

(1-3-4) The print device is provided with a plurality of side surfaces. Each of the plurality of side surfaces is substantially parallel to the up-down direction. The first discharge portion is configured to discharge the first medium from a first side surface included in the plurality of side surfaces. The second discharge portion is configured to discharge the second medium from a second side surface included in the plurality of side surfaces. The first side surface and the second side surface face each other.

According to this, the first medium and the second medium are discharged in opposite directions from the two side surfaces that face each other. Therefore, the discharged first medium and the discharged second medium are unlikely to become mixed outside the print device.

(1-3-5) The print device is provided with a plurality of side surfaces. Each of the plurality of side surfaces is substantially parallel to the up-down direction. The first discharge portion and the second discharge portion are configured to respectively discharge the first medium and the second medium from the same side surface of the plurality of side surfaces. The first discharge portion includes a discharge roller configured to feed the first medium in the first direction. The second discharge portion includes a discharge guide having an opening portion configured to guide the second medium in the second direction.

According to this, the first medium and the second medium are discharged from the same side surface by different discharge mechanisms. For example, when the distance by which the first discharge portion discharges the first medium is made to be different from the distance by which the second discharge portion discharges the second medium, it may be possible to inhibit the discharged first medium and the second medium from becoming mixed outside the print device.

(1-3-6) The print device is provided with a wall portion disposed between the first discharge area and the second discharge area. The first discharge area is an area in which the first medium discharged by the first discharge portion is arranged outside the print device. The second discharge area is an area in which the second medium discharged by the second discharge portion is arranged outside the print device.

According to this, the first medium discharged to the first discharge area and the second medium discharged to the second discharge area are inhibited from becoming mixed with each other by the wall portion disposed between the first discharge area and the second discharge area.

(1-3-7) The print device is provided with a plurality of surfaces and a medium insertion portion including an opening into which the second medium is inserted. The medium insertion portion is disposed in one of the plurality of surfaces that is other than a surface from which the first medium is discharged by the first discharge portion and a surface from which the second medium is discharged by the second discharge portion.

According to this, the second print medium before printing is inserted from the surface that is other than the surface from which the first medium after printing is discharged and the surface from which the second medium after printing is discharged. It may be possible to inhibit the second medium before printing from interfering with the discharged first medium and the discharged second medium.

(1-3-8) In the print device, the first medium is a tape that is a strip-shaped print medium. The second medium is a tube that is a cylindrical print medium.

According to this, the print device may respectively print the two print media having different shapes.

1-4. Second Example of Functions According to First Embodiment

A second example of functions according to the first embodiment will be described.

(1-4-1) A print device is provided with a tape mounting portion, a tape print portion, a tape discharge portion, a tube mounting portion, a ribbon mounting portion, a tube print portion, and a tube discharge portion. The tape mounting portion is configured such that a tape is detachably mounted in the tape mounting portion. The tape is a strip-shaped print medium. The tape print portion is configured to print on the tape mounted in the tape mounting portion. The tape discharge portion is configured to discharge the tape printed by the tape print portion to the outside of the print device. The tube mounting portion is configured such that a tube is detachably mounted in the tube mounting portion along a predetermined direction. The tube is a cylindrical print medium. The ribbon mounting portion is configured such that an ink ribbon is detachably mounted in the ribbon mounting portion. The tube print portion is configured to print on the tube mounted in the tube mounting portion, using the ink ribbon mounted in the ribbon mounting portion. The tube discharge portion is configured to discharge the tube printed by the tube print portion to the outside of the print device. The tape mounting portion and the ribbon mounting portion are disposed on the same side with respect to the tube mounting portion, and are disposed side by side along the predetermined direction. The tape discharge portion may be a discharge roller configured to feed the tape printed by the tape print portion to the outside of the print device.

According to this, the tape mounting portion and the ribbon mounting portion are disposed side by side along an extending direction of the tube mounting portion on the same side with respect to the tube mounting portion. Since the tape mounting portion and the ribbon mounting portion are disposed in this manner, the size of the print device may be inhibited from being increased in a direction (for example, the front-rear direction of the first embodiment) that intersects the predetermined direction. Since the tape mounting portion and the ribbon mounting portion are disposed effectively in terms of space, it may be possible to downsize the print device that has the tube printing mechanism and the tape printing mechanism.

(1-4-2) The print device is provided with a plurality of surfaces. The plurality of surfaces include a first surface, a second surface and a third surface. The second surface and the third surface are disposed on both end sides of the first surface such that the second surface and the third surface face each other. At least a part of the tape mounting portion and at least a part of the ribbon mounting portion are disposed side by side in a direction in which the second surface and the third surface face each other.

According to this, it may be possible to further inhibit the size of the print device from being increased in the direction that intersects the predetermined direction.

(1-4-3) The print device is provided with a tube supply portion disposed at an end portion on the upstream side in the predetermined direction of the tube mounting portion. The tube supply portion includes an opening configured to guide the tube to the inside of the print device. The tube print portion is configured to print on the tube mounted in the tube mounting portion while feeding, in the predetermined direction, the tube mounted in the tube mounting portion. The tube supply portion is disposed in the second surface.

According to this, for example, the user on the first surface side of the print device may insert the tube before printing from the second surface that is adjacent to the first surface. Thus, the operability of the print device may be improved.

(1-4-4) The print device is provided with a tube supply portion disposed at an end portion on the upstream side in the predetermined direction of the tube mounting portion. The tube supply portion includes an opening configured to guide the tube to the inside of the print device. The plurality of surfaces include a fourth surface that is a surface opposite to the first surface. The tube print portion is configured to print on the tube mounted in the tube mounting portion while feeding, in the predetermined direction, the tube mounted in the tube mounting portion. The tube supply portion is disposed in the fourth surface.

According to this, for example, the tube before printing may be easily disposed on the fourth surface side of the print device. When the user is on the first surface side of the print device, since the tube before printing is disposed on the opposite side to the user with the print device interposed therebetween, the operability of the print device may be improved.

(1-4-5) In the print device, the tube print portion is configured to print on the tube mounted in the tube mounting portion while feeding, in the predetermined direction, the tube mounted in the tube mounting portion. The tube discharge portion is disposed at an end portion on the downstream side in the predetermined direction of the tube mounting portion, and in the third surface. The tube discharge portion includes an opening configured to guide the tube to the outside of the print device.

According to this, for example, the user on the first surface side of the print device may retrieve the tube after printing from the third surface that is adjacent to the first surface. Thus, the operability of the print device may be improved.

(1-4-6) The print device is provided with a tube supply portion disposed at an end portion on the upstream side in the predetermined direction of the tube mounting portion. The tube supply portion includes an opening configured to guide the tube to the inside of the print device. The tube print portion is configured to print on the tube mounted in the tube mounting portion while feeding, in the predetermined direction, the tube mounted in the tube mounting portion. The tube discharge portion is disposed at an end portion on the downstream side in the predetermined direction of the tube mounting portion. The tube discharge portion includes an opening configured to guide the tube to the outside of the print device. The tube supply portion and the tube discharge portion are disposed in surfaces that are different from each other among the plurality of surfaces. The tape discharge portion is configured to discharge the tape printed by the tape print portion, from one of the plurality of surfaces that is other than the surface in which the tube supply portion is disposed and the surface in which the tube discharge portion is disposed.

According to this, the printed tape is discharged from a surface other than the surfaces in which the tube supply portion and the tube discharge portion are respectively disposed. Thus, it may be possible to inhibit the printed tape from interfering with the tube.

(1-4-7) The print device is provided with a tube supply portion disposed at an end portion on the upstream side in the predetermined direction of the tube mounting portion. The tube supply portion includes an opening configured to guide the tube to the inside of the print device. The tube print portion is configured to print on the tube mounted in the tube mounting portion while feeding, in the predetermined direction, the tube mounted in the tube mounting portion. The tube discharge portion is disposed at an end portion on the downstream side in the predetermined direction of the tube mounting portion. The tube discharge portion includes an opening configured to guide the tube to the outside of the print device. The tube supply portion is disposed in the second surface. The tube discharge portion is disposed in the third surface and is disposed on the first surface side relative to the tube supply portion.

According to this, it may be possible to increase a distance between the tube supply portion and the tube discharge portion. Therefore, it may be possible to inhibit interference between the tube before printing and the tube after printing. Further, the tube discharge portion is located on the first surface side relative to the tube supply portion. For example, the user on the first surface side may retrieve the tube after printing from a position that is close to the first surface. Thus, the operability of the print device may be improved.

(1-4-8) The print device is provided with a main body portion and a cover. The tape mounting portion, the tube mounting portion and the ribbon mounting portion are disposed in the main body portion. The cover is configured to be displaced between a position in which the cover open a top surface of the main body portion and a position in which the cover close the top surface of the main body portion. The tape mounting portion, the tube mounting portion and the ribbon mounting portion have attaching openings via which the tape, the tube and the ink ribbon are respectively attachable and detachable from above in a state in which the top surface of the main body portion is opened by the cover.

According to this, in a state in which the cover is opened, the user may attach and detach the tape, the tube and the ink ribbon to and from the tape mounting portion, the tube mounting portion and the ribbon mounting portion, respectively, from above. Thus, the operability of the print device may be improved.

2. Second Embodiment

2-1. Structural Description of Print Device 101

Figure 8:
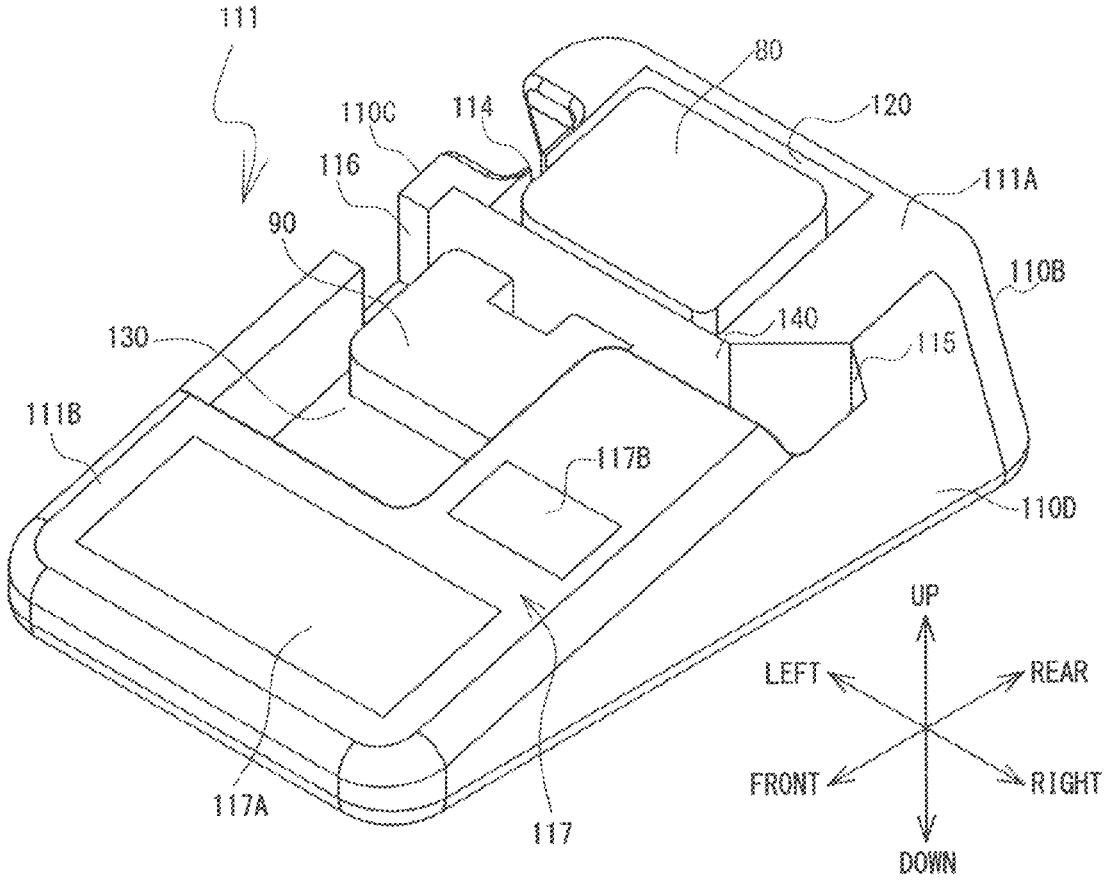
FIG. 8 is a perspective view of a main body case as viewed from the upper right front side.
Figure 9:
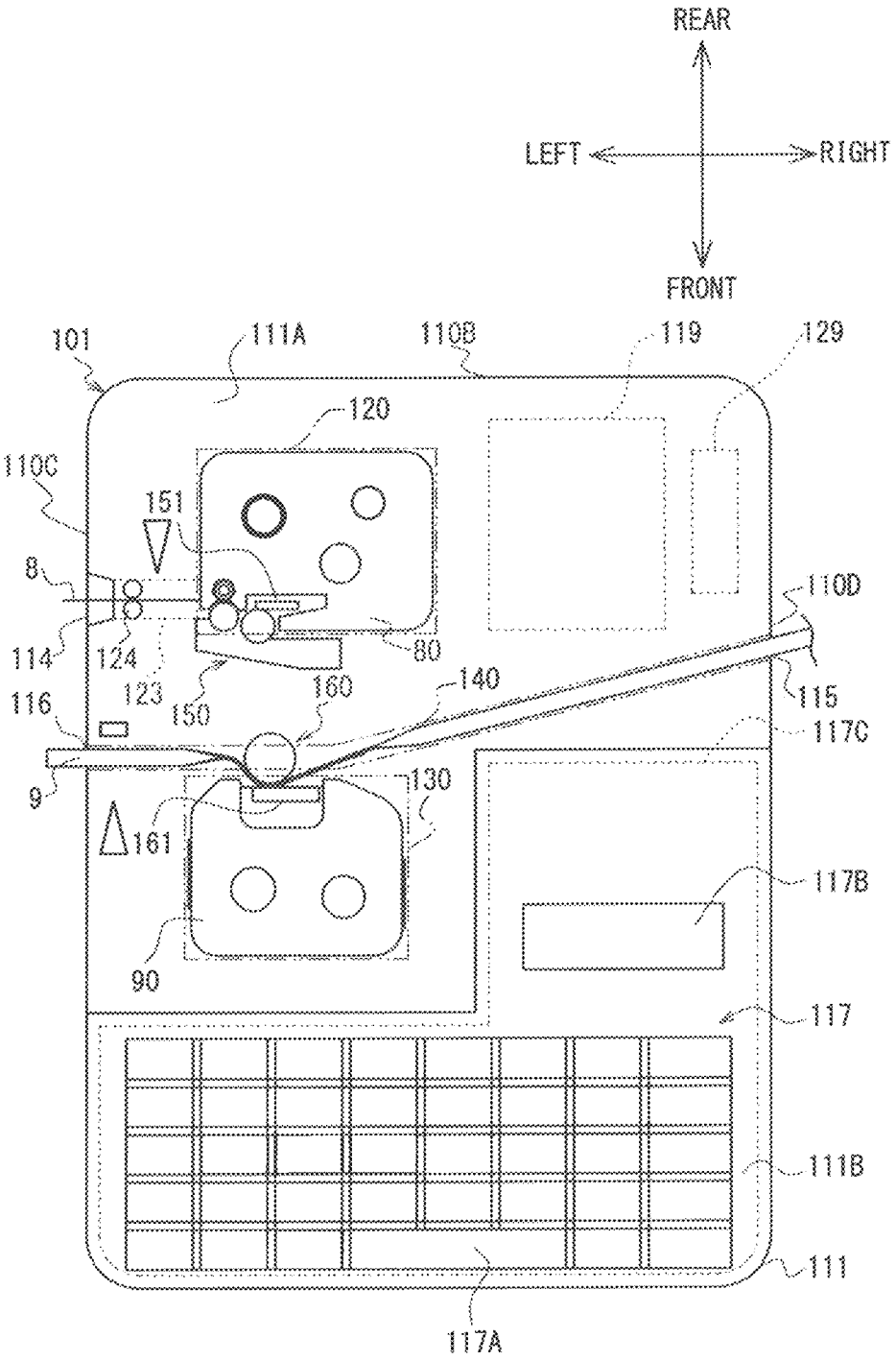
FIG. 9 is a plan view schematically showing an internal structure of the print device.

A second embodiment of the present disclosure will be described with reference to the drawings. A print device 101 according to the second embodiment will be described with reference to FIG. 7 to FIG. 9. In FIG. 8, the tape cassette 80 and the ribbon cassette 90 are schematically shown, and a tape printing mechanism 150 and a tube printing mechanism 160 are omitted. FIG. 9 shows a state in which the tape cassette 80, the ribbon cassette 90 and the tube 9 are respectively mounted in a tape mounting portion 120, a ribbon mounting portion 130 and a tube mounting portion 140 (this also applies to FIG. 10A and FIG. 10B, which will be described later).

Figure 7:
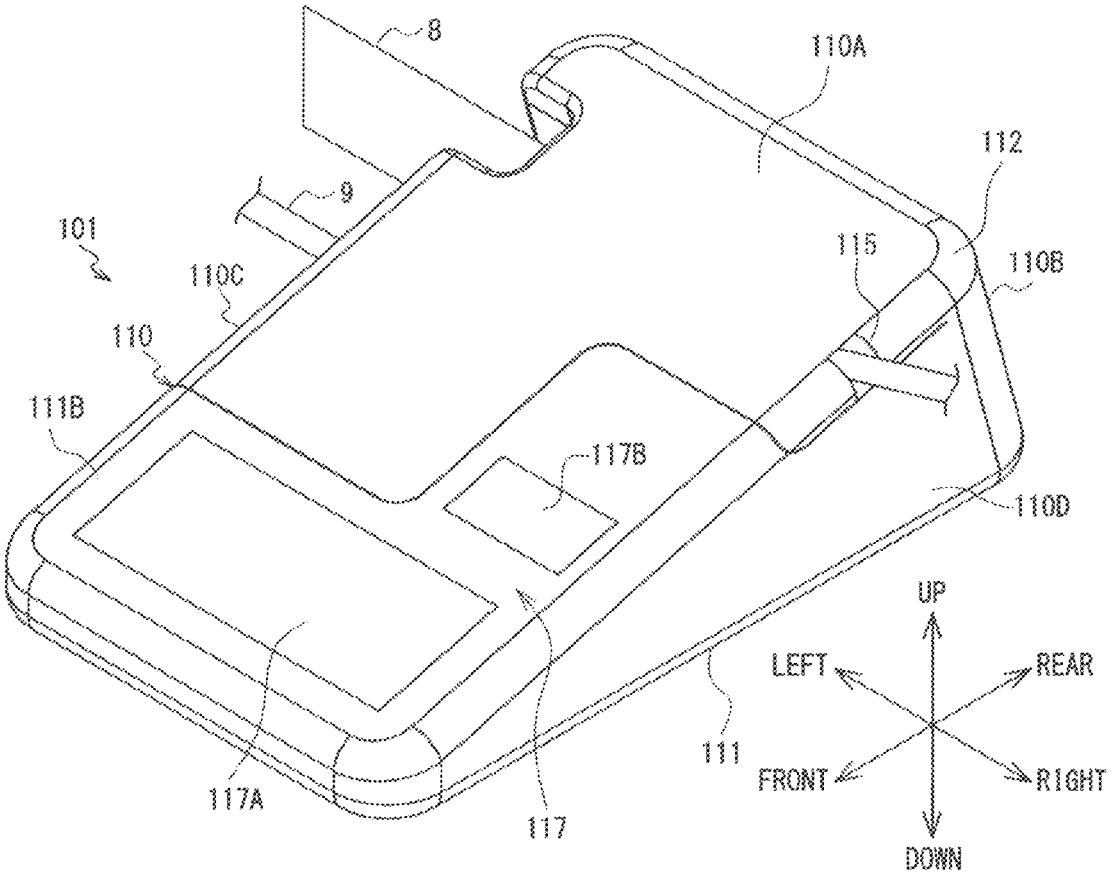
FIG. 7 is a perspective view of a print device as viewed from the upper right front side.

In the description below, the upper side, the lower side, the lower right side, the upper left side, the upper right side and the lower left side of FIG. 7 are respectively defined as the upper side, the lower side, the right side, the left side, the rear side and the front side of the print device 101. The tape 8, the tube 9, the tape cassette 80 and the ribbon cassette 90 are the same as those of the first embodiment. The length of the tape 8 in the width direction (36 mm in the present example) is larger than the diameter of the tube 9 (6 mm in the present example).

As shown in FIG. 7 and FIG. 8, the print device 101 is configured to print the tape 8 and the tube 9 using the two printing mechanisms, respectively. The print device 101 is provided with a housing 110 that includes a main body case 111 and a cover 112. The housing 110 has a plurality of surfaces, namely, a top surface 110A, a rear surface 110B, a left surface 110C and a right surface 110D. The rear surface 110B has a rectangular shape that is long in the left-right direction in a front view. The top surface 110A is an inclined surface that extends forward and downward from an upper end portion of the rear surface 110B. The left surface 110C and the right surface 110D are surfaces that face each other in the left-right direction, and are respectively provided on the left side and the right side of the top surface 110A and the rear surface 110B.

The main body case 111 is a box-shaped member that is long in the front-rear direction. The top surface of the main body case 111 includes a mounting surface 111A and a case front surface 111B. In the present example, the mounting surface 111A is provided across a rear portion of the main body case 111 and the left side of a central portion of the main body case 111. The case front surface 111B is provided on the front side of the mounting surface 111A, and is provided across a front portion of the main body case 111 and the right side of the central portion of the main body case 111.

The cover 112 is a plate-shaped member, and is disposed on an upper portion on the rear side of the main body case 111. A rear end portion of the cover 112 is rotatably supported by the upper side of a rear end portion of the main body case 111. In the present example, a front left portion of the cover 112 extends forward further than a front right portion of the cover 112. When the cover 112 is closed with respect to the main body case 111, the cover 112 covers the mounting surface 111A (refer to FIG. 7). In a state in which the cover 112 is closed, the case front surface 111B and the top surface of the cover 112 form the top surface 110A. When the user opens the cover 112, the user causes the cover 112 to pivot upward from the main body case 111. When the cover 112 is opened with respect to the main body case 111, the mounting surface 111A is exposed in the upward direction (refer to FIG. 8).

The housing 110 is provided with a tape discharge opening 114, a tube insertion opening 115, a tube discharge opening 116 and a user interface portion 117. The tape discharge opening 114 is an opening to discharge the tape 8 to the outside of the housing 110. The tape discharge opening 114 is provided in an upper portion on the rear side of the left surface 110C, and has a rectangular shape that is long in the up-down direction.

The tube insertion opening 115 is an opening to guide the tube 9 to the inside of the housing 110. The tube insertion opening 115 is provided in an upper portion on the rear side of the right surface 110D, and has a rectangular shape that is slightly longer in the up-down direction. The tube discharge opening 116 is an opening to discharge the tube 9 to the outside of the housing 110. The tube discharge opening 116 is provided in an upper portion on the rear side of the left surface 110C, and has a rectangular shape that is slightly longer in the up-down direction. The tube discharge opening 116 is located slightly to the front of the tube insertion opening 115 and the tape discharge opening 114. The tube discharge direction is determined by an orientation of the tube discharge opening 116. In the present example, since the tube discharge opening 116 is directed leftward and substantially horizontally, the tube discharge direction is also a substantially horizontal and leftward direction.

The user interface portion 117 includes an operation portion 117A, a display portion 117B and a board 117C (refer to FIG. 9). The operation portion 117A of the present example is a rectangular keyboard that is long in the left-right direction. The display portion 117B of the present example is a compact rectangular liquid crystal display. The user interface portion 117 of the present example is a known keyboard/display unit (KDU) in which the operation portion 117A and the display portion 117B are integrally provided on the board 117C. The board 117C is fixed to a lower surface of the case front surface 111B. The operation portion 117A is disposed on a front portion of the case front surface 111B. The display portion 117B is disposed on a rear right portion of the case front surface 111B. The operation portion 117A and the display portion 117B are both directed upward and forward. The user interface portion 117 may include at least one of the operation portion 117A and the display portion 117B.

As shown in FIG. 8, the tape mounting portion 120, the ribbon mounting portion 130, the tube mounting portion 140 and the like are provided in the mounting surface 111A. The tape mounting portion 120 has a similar structure to the tape mounting portion 20 (refer to FIG. 3). The tape mounting portion 120 of the present example is provided in a rear left portion of the mounting surface 111A. A feed path 123 (refer to FIG. 9) extends continuously leftward from a front left portion of the tape mounting portion 120. A tape guide 124 (refer to FIG. 9) is provided in the feed path 123. The tape guide 124 of the present example has a similar structure to the tape guide 24 (refer to FIG. 3), and determines the tape discharge direction to be the substantially horizontal and leftward direction. The ribbon mounting portion 130 has a similar structure to the ribbon mounting portion 30 (refer to FIG. 3). The ribbon mounting portion 130 of the present example is provided in a front left portion of the mounting surface 111A.

The tube mounting portion 140 has a similar structure to the tube mounting portion 40 (refer to FIG. 3), and extends from the tube insertion opening 115 to the tube discharge opening 116. The tube mounting portion 140 of the present example extends substantially in the left-right direction in front of the tube mounting portion 120 and behind the ribbon mounting portion 130. In other words, the tube mounting portion 140 extends via a space between the tape mounting portion 120 and the ribbon mounting portion 130 in a plan view. Since the tube discharge opening 116 is located slightly to the front of the tube insertion opening 115, the tube mounting portion 140 is slightly inclined toward the front left side and extends substantially in the left-right direction.

In a state in which the cover 112 (refer to FIG. 7) is opened, the user can attach and detach the tape cassette 80, the ribbon cassette 90 and the tube 9 to and from the tape mounting portion 120, the ribbon mounting portion 130 and the tube mounting portion 140, respectively, from above. The user mounts the tube 9 in the tube mounting portion 140 such that the tube 9 extends from the tube insertion opening 115 to the tube discharge opening 116.

A control board 119, a power source portion 129, the tape printing mechanism 150 and the tube printing mechanism 160 will be described with reference to FIG. 9. The control board 119 is similar to the control board 19 (refer to FIG. 4), and controls various operations of the print device 101. The power source portion 129 is similar to the power source portion (not shown in the drawings) of the first embodiment, and supplies power to the print device 101. In the present example, the control board 119 is provided on a rear right portion inside the main body case 111, and extends in the front-rear direction and the left-right direction. The power source portion 129 is provided to the right of the control board 119. The above-described tube mounting portion 140 extends substantially in the left-right direction in front of the control board 119 and the power source portion 129.

Since the tape printing mechanism 150 is similar to the tape printing mechanism 50 (refer to FIG. 4), a brief description will be made. The tape printing mechanism 150 includes a print head 151, a platen holder, a platen roller, a movable feed roller, a tape drive shaft, a ribbon take-up shaft, a cutter, a first drive motor, a cutter motor, a second drive motor and the like. The print head 151, the tape drive shaft and the ribbon take-up shaft are each provided so as to stand upward from the bottom surface of the tape mounting portion 120. The print head 151 is provided on a front left portion of the tape mounting portion 120. The platen holder is disposed in front of the tape mounting portion 120, and is configured to be displaced between an operating position and a retracted position in accordance with the opening and closing of the cover 112 (refer to FIG. 7). The cutter is provided on the right side of the tape guide 124 in the feed path 123.

In the present example, a main scanning direction of the tape printing mechanism 150 is substantially parallel to the up-down direction. The main scanning direction of the tape printing mechanism 150 is a direction in which a plurality of heating elements provided on the print head 151 are aligned. The print head 151 performs printing one line at a time on the tape 8 that is fed in a sub-scanning direction, using the heating elements that are aligned in the main scanning direction. A length in the main scanning direction of the tape printing mechanism 150 is mainly determined by a length in the main scanning direction of the print head 151. The length in the main scanning direction of the print head 151 is at least equal to or more than a length in the width direction of the tape 8. When the length in the width direction of the tape 8 is equal to or less than the length in the main scanning direction of the print head 151, the tape printing mechanism 150 can appropriately perform printing on the tape 8.

The tape printing mechanism 150 of the present example has the following positional relationships with the other structural elements. At least a part of the tape printing mechanism 150 and at least a part of the user interface portion 117 overlap with each other in the front-rear direction. In the present example, since a left portion of the user interface portion 117 is disposed to the front of the tape printing mechanism 150, the left portion of the user interface portion 117 overlaps with the tape printing mechanism 150 in a front view. In the present example, an upper end portion of the tape printing mechanism 150 is higher than an upper end portion of the user interface portion 117. A lower end portion of the tape printing mechanism 150 is lower than a lower end portion of the user interface portion 117. In other words, the entire vertical range of the user interface portion 117 is included in the vertical range of the tape printing mechanism 150.

The tape printing mechanism 150 and the power source portion 129 are arranged side by side in the left-right direction when viewed in the up-down direction. At least a part of the tape printing mechanism 150 and at least a part of the power source portion 129 overlap with each other in the left-right direction. The power source portion 129 of the present example is aligned to the right side of the tape printing mechanism 150 in a plan view, and overlaps with the tape printing mechanism 150 in a side view. In the present example, the entire vertical range of the power source portion 129 is included in the vertical range of the tape printing mechanism 150.

In a similar manner, the tape printing mechanism 150 and the control board 119 are arranged side by side in the left-right direction when viewed in the up-down direction. At least a part of the tape printing mechanism 150 and at least a part of the control board 119 overlap with each other in the left-right direction. The control board 119 of the present example is aligned to the right side of the tape printing mechanism 150 in a plan view, and overlaps with the tape printing mechanism 150 in a side view. In the present example, the entire vertical range of the control board 119 is included in the vertical range of the tape printing mechanism 150.

The tape printing mechanism 150 performs printing operations in accordance with control of the control board 119, in a similar manner to the first embodiment. The print head 151 of the present example performs mirror image printing, and prints characters on the rear surface of the film tape 85 (refer to FIG. 4) that passes through the front side of the print head 151. The created tape 8 passes through the tape guide 124 in the feed path 123, and is discharged from the tape discharge opening 114 in a posture in which the width direction of the tape 8 is substantially parallel to the up-down direction. At this time, the tape 8 is discharged leftward from the left surface 110C such that the print surface of the tape 8 is directed forward. After the tape 8 is cut, the tape 8 falls into a tape discharge area (not shown in the drawings) located on the left side of the housing 110 (refer to FIG. 7).

Since the tube printing mechanism 160 is similar to the tube printing mechanism 60 (refer to FIG. 4), a brief description will be made. The tube printing mechanism 160 includes a print head 161, a movable feed roller, a ribbon take-up shaft, a cutter, a cutting board, a drive motor, a cutter motor and the like. The print head 161 and the ribbon take-up shaft are each provided so as to stand upward from the bottom surface of the ribbon mounting portion 130. The print head 161 is provided on a rear portion of the ribbon mounting portion 130. The movable feed roller is disposed on the rear side of the ribbon mounting portion 130, and is configured to be displaced between an operating position and a retracted position in accordance with the opening and closing of the cover 112 (refer to FIG. 7). The cutter and the cutting board are disposed between the tube discharge opening 116 and the ribbon mounting portion 130 such that the cutter and the cutting board face each other with the tube mount portion 140 interposed therebetween.

In the present example, a main scanning direction of the tube printing mechanism 160 is substantially parallel to the up-down direction. The main scanning direction of the tube printing mechanism 160 is a direction in which a plurality of heating elements provided on the print head 161 are aligned. The print head 161 performs printing one line at a time on the tube 9 that is fed in a sub-scanning direction, using the heating elements that are aligned in the main scanning direction. A length in the main scanning direction of the tube printing mechanism 160 is mainly determined by a length in the main scanning direction of the print head 161.

The length in the main scanning direction of the print head 161 is at least equal to or more than a print width of the tube 9. The print width of the tube 9 is a length in the main scanning direction of a range over which the tube 9 comes into surface-contact with the print head 161 via the ink ribbon 93 in a state in which the movable feed roller urges the tube 9 and the ink ribbon 93 (refer to FIG. 4) toward the print head 161. Note, however, that the length in the main scanning direction of the tube printing mechanism 160 is shorter than the length in the main scanning direction of the tape printing mechanism 150. When the print width of the tube 9 is equal to or less than the length in the scanning direction of the print head 161, the tube printing mechanism 160 can appropriately perform printing on the tube 9.

The tube printing mechanism 160 of the present example has the following positional relationships with the other structural elements. The tube printing mechanism 160 is provided to the front of the tape printing mechanism 150. Since the tube printing mechanism 160 of the present example is disposed in front of the tape printing mechanism 150, it overlaps with the tape printing mechanism 150 in a front view. In the present example, the entire vertical range of the tube printing mechanism 160 is included in the vertical range of the tape printing mechanism 150.

The tube printing mechanism 160 and at least a part of the user interface portion 117 are arranged side by side in the left-right direction when viewed in the up-down direction. At least a part of the tube printing mechanism 160 and at least a part of the user interface portion 117 overlap with each other in the front-rear direction. In the present example, a rear right portion of the user interface portion 117 is aligned to the right side of the tube printing mechanism 160 in a plan view. Since the left portion of the user interface portion 117 is disposed to the front of the tube printing mechanism 160, the left portion of the user interface portion 117 overlaps with the tube printing mechanism 160 in a front view. In the present example, an upper end portion of the tube printing mechanism 160 is lower than the upper end portion of the user interface portion 117. A lower end portion of the tube printing mechanism 160 is higher than the lower end portion of the user interface portion 117. In other words, the entire vertical range of the tube printing mechanism 160 is included in the vertical range of the user interface portion 117.

The tube printing mechanism 160 performs printing operations in accordance with control of the control board 119, in a similar manner to the first embodiment. The tube 9 before printing is guided from a rear portion of the right surface 110D to the inside of the tube mounting portion 140 via the tube insertion opening 115. The tube 9 after printing is discharged via the tube discharge opening 116. At this time, the tube 9 is discharged leftward from a rear portion of the left surface 110C in the posture in which the print surface of the tube 9 is directed forward. The tube 9 after printing is cut, and thereafter, it falls into a tube discharge area (not shown in the drawings) located on the left side of the housing 110.

In the print device 101 of the present example, the respective members, such as the user interface portion 117, the tube mounting portion 140, the control board 119, the power source portion 129 and the like, are disposed such that they fall within the vertical range of the tape printing mechanism 150 whose length in the up-down direction is relatively large. Therefore, the length in the up-down direction of the print device 101 (namely, the height of the print device 101) is suppressed.

2-2. Structural Description of Print Devices According to Modified Examples

The present disclosure is not limited the structure exemplified by the print device 101 (refer to FIG. 7 to FIG. 9), and various modifications are possible. Print devices 102 and 103 according to modified examples will be described with reference to FIG. 10A and FIG. 10B. In the description below, structural elements corresponding to those of the print device 101 are denoted by the same reference numerals and a description thereof will be omitted, and points that are different from the print device 101 will be mainly described.

The print device 102 will be described with reference to FIG. 10A. The main body case 111 has a substantially square shape in a plan view, and its length in the front-rear direction is shorter in comparison to the structure shown in FIG. 7 to FIG. 9. The case front surface 111B is the same as in the structure shown in FIG. 9. On the other hand, the length in the front-rear direction of the mounting surface 111A is reduced in comparison to the structure shown in FIG. 9. Although not shown in the drawings, the length in the front-rear direction of the cover 112 (refer to FIG. 7) is also reduced corresponding to the mounting surface 111A.

In the present example, a front end portion of the case front surface 111B is rotatably supported by a front end portion of the main body case 111. The case front surface 111B is configured to be opened and closed with respect to the main body case 111 by the user from above. In a state in which both of the cover 112 and the case front surface 111B are closed, the top surface of the cover 112 and the top surface of the case front surface 111B form the top surface 110A (refer to FIG. 7). In the same manner as the structure shown in FIG. 7, the top surface 110A extends forward and downward from the upper end portion of the rear surface 110B.

The tube insertion opening 115 is provided in the center of an upper portion of the right surface 110D. The tube discharge opening 116 is provided in an upper portion on the front side of the left surface 110C. The ribbon mounting portion 130 and the tube printing mechanism 160 are provided in a front left portion of the main body case 111. The ribbon mounting portion 130 and the tube printing mechanism 160 are located in front of the tape mounting portion 120 and the tape printing mechanism 150 and below the user interface portion 117. The tube mounting portion 140 extends substantially in the left-right direction in front of the tape mounting portion 120 and behind the ribbon mounting portion 130. The tube mounting portion 140 is located below the user interface portion 117. In a plan view, the rear right portion of the user interface portion 117 is aligned to the right side of the tape mounting portion 120 and the tape printing mechanism 150, and at least a part of it overlaps with the control board 119 and the power source portion 129.

In a state in which the cover 112 is opened, the user can attach and detach the tape cassette 80 to and from the tape mounting portion 120 from above. In a state in which the case front surface 111B is opened, the user can attach and detach the ribbon cassette 90 and the tube 9 to and from the ribbon mounting portion 130 and the tube mounting portion 140, respectively, from above. The other structural elements are the same as those of the print device 101. In the print device 102, the tape 8 and the tube 9 are printed and discharged in the same manner as in the print device 101. More specifically, the printed tape 8 and the tube 9 after printing are discharged from the same side surface (namely, the left surface 110C) of the print device 102 in a posture in which their print surfaces are directed forward.

The print device 103 will be described with reference to FIG. 10B. The print device 103 is different from the print device 102 (refer to FIG. 10A) in the following points. The tape discharge opening 114 is provided in an upper portion on the rear side of the right surface 110D. The tape mounting portion 120, the tape printing mechanism 150, the control board 119 and the power source portion 129 are respectively left-right inverted with respect to a virtual line that extends in the front-rear direction and that passes through substantially the center of the main body case 111 in a plan view, in comparison to the arrangement of each of them shown in FIG. 10A. The feed path 123 extends to the right from the tape mounting portion 120 and connects to the tape discharge opening 114.

Figure 10A:
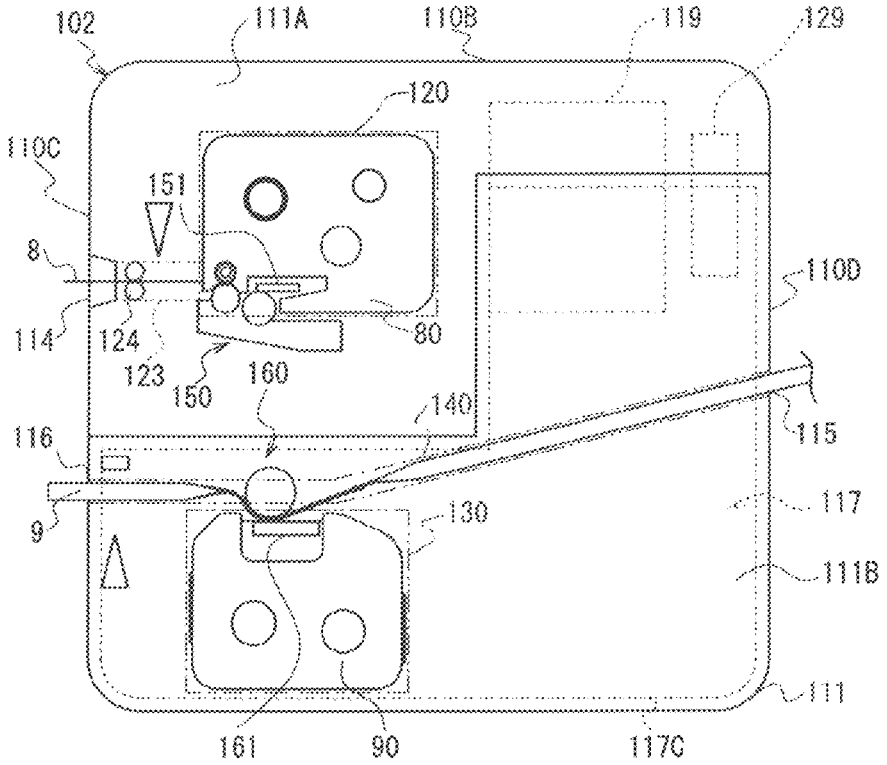
FIG. 10A and FIG. 10B are plan views respectively, schematically showing internal structures of print devices.

In comparison to the arrangement of each of the cover 112 and the user interface portion 117 shown in FIG. 10A, the cover 112 and the user interface portion 117 are respectively left-right inverted with respect to the virtual line that extends in the front-rear direction and that passes through substantially the center of the main body case 111 in a plan view. Therefore, in a plan view, a rear left portion of the user interface portion 117 is aligned to the left side of the tape mounting portion 120 and the tape printing mechanism 150, and at least a part of it overlaps with the control board 119 and the power source portion 129. The other structural elements are the same as those of the print device 102. In the print device 103, the printed tape 8 is discharged rightward from the right surface 110D via the tape discharge opening 114. More specifically, the printed tape 8 and the tube 9 after printing are discharged from different side surfaces (namely, the left surface 110C and the right surface 110D) of the print device 103 in a posture in which their print surfaces are directed forward.

Figure 10B:
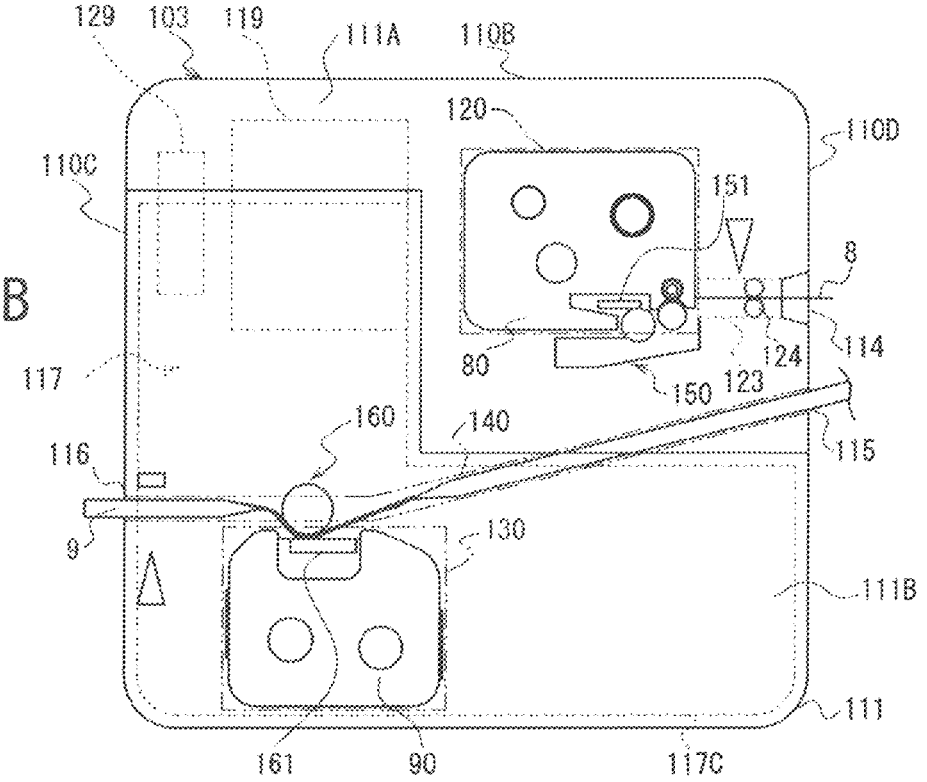

As shown in FIG. 10A and FIG. 10B, the tube printing mechanism 160 is provided below the user interface portion 117. At least a part of the tube printing mechanism 160 and at least a part of the user interface portion 117 overlap with each other in the up-down direction. In the present example, the whole of the tube printing mechanism 160 is included in the range of the user interface portion 117 in a plan view. Therefore, the length in the front-rear direction of each of the print devices 102 and 103 is suppressed. Further, an upper portion of the tube printing mechanism 160 overlaps with a front left portion of the user interface portion 117 in a front view. Therefore, the length in the up-down direction of each of the print devices 102 and 103 is suppressed.

2-3. Examples of Functions According to Second Embodiment

Functions according to the second embodiment will be exemplified.

(2-3-1) A print device is provided with a first print portion, a first discharge portion, a second print portion, a second discharge portion, and a user interface portion. The first print portion is configured to print on a first medium. The first discharge portion is configured to discharge the first medium printed by the first print portion to the outside of the print device. The second print portion is configured to print on a second medium. The second discharge portion is configured to discharge the second medium printed by the second print portion to the outside of the print device. The user interface portion is disposed on a front side portion of the print device. The user interface portion includes at least one of a display portion and an operation portion. A main scanning direction of the first print portion and a main scanning direction of the second print portion are substantially parallel to the up-down direction. A length in the up-down direction of the second print portion is shorter than a length in the up-down direction of the first print portion. The second print portion is disposed to the front of the first print portion.

According to this, the user interface portion is disposed in the front side portion of the print device. The second print portion, whose length in the up-down direction is relatively short, is disposed to the front of the first print portion, whose length in the up-down direction is relatively long. It may be easy to realize the print device having a structure in which the user interface portion and the first print portion do not overlap with each other in the up-down direction. Therefore, it may be possible to suppress the height (the length in the up-down direction) of the print device that is provided with the two printing mechanisms and at least one of the operation portion and the display portion.

(2-3-2) In the print device, the second print portion is disposed below the user interface portion. At least a part of the second print portion and at least a part of the user interface portion overlap with each other in the up-down direction.

According to this, the second print portion is disposed below the user interface portion such that at least a part of the second print portion and at least a part of the user interface portion overlap with each other in a plan view. Thus, it may be possible to suppress the length of the print device in the front-rear direction.

(2-3-3) In the print device, at least a part of the first print portion and at least a part of the user interface portion overlap with each other in the front-rear direction.

According to this, the user interface portion is disposed to the front of the first print portion such that at least a part of the first print portion and at least a part of the user interface portion overlap with each other in a front view. Thus, it may be possible to suppress the length of the print device in the left-right direction.

(2-3-4) In the print device, the second print portion and the user interface portion are disposed side by side in the left-right direction when viewed in the up-down direction.

According to this, the second print portion and the user interface portion are disposed side by side in the left-right direction in a plan view. Thus, it may be possible to suppress the length of the print device in the front-rear direction.

(2-3-5) In the print device, at least a part of the second print portion and at least a part of the user interface portion overlap with each other in the front-rear direction.

According to this, at least a part of the second print portion and at least a part of the user interface portion overlap with each other in a front view. Thus, it may be possible to suppress the length of the print device in the up-down direction.

(2-3-6) The print device is provided with a power source portion. The first print portion and the power source portion are disposed side by side in the left-right direction when viewed in the up-down direction.

According to this, the first print portion and the power source portion are disposed side by side in the left-right direction in a plan view. Thus, it may be possible to suppress the length of the print device in the front-rear direction.

(2-3-7) In the print device, at least a part of the first print portion and at least a part of the power source portion overlap with each other in the left-right direction.

According to this, at least a part of the first print portion and at least a part of the power source portion overlap with each other in a side view. Thus, it may be possible to suppress the length of the print device in the up-down direction.

(2-3-8) The print device is provided with a feed portion configured to feed the second medium toward the second print portion. The feed portion is disposed to the front of the power source portion.

According to this, the feed portion supplies the second medium to the second print portion using an area in front of the power source portion. Thus, it may be possible to suppress the print device from being increased in size.

(2-3-9) The print device is provided with a board. The first print portion and the board are disposed side by side in the left-right direction when viewed in the up-down direction.

According to this, the first print portion and the board are disposed side by side in the left-right direction in a plan view. Thus, it may be possible to suppress the length of the print device in the front-rear direction.

(2-3-10) In the print device, the first discharge portion and the second discharge portion are configured to respectively discharge the first medium and the second medium from the same side surface of the print device.

According to this, the first medium and the second medium are discharged from the same side surface of the print device. Therefore, it may be easy for the user to retrieve the first medium and the second medium after printing.

(2-3-11) In the print device, the first discharge portion and the second discharge portion are configured to respectively discharge the first medium and the second medium from side surfaces of the print device that are different from each other.

According to this, the first medium and the second medium are discharged from the different side surfaces of the print device. Therefore, it may be possible to inhibit the first medium and the second medium that have been printed from becoming mixed with each other.

(2-3-12) In the print device, the first discharge portion is configured to discharge the first medium to the outside of the print device in a state in which a print surface of the first medium printed by the first print portion is directed to the front. The second discharge portion is configured to discharge the second medium to the outside of the print device in a state in which a print surface of the second medium printed by the second print portion is directed to the front.

According to this, the user may visually check the print surface of the first medium and the print surface of the second medium simultaneously from the front of the print device.

(2-3-13) In the print device, the first medium is a tape that is a strip-shaped print medium. The second medium is a tube that is a cylindrical print medium.

According to this, the print device may respectively print the two print media having different shapes.

3. Third Embodiment

3-1. Structural Description of Print Device 201

Figure 11:
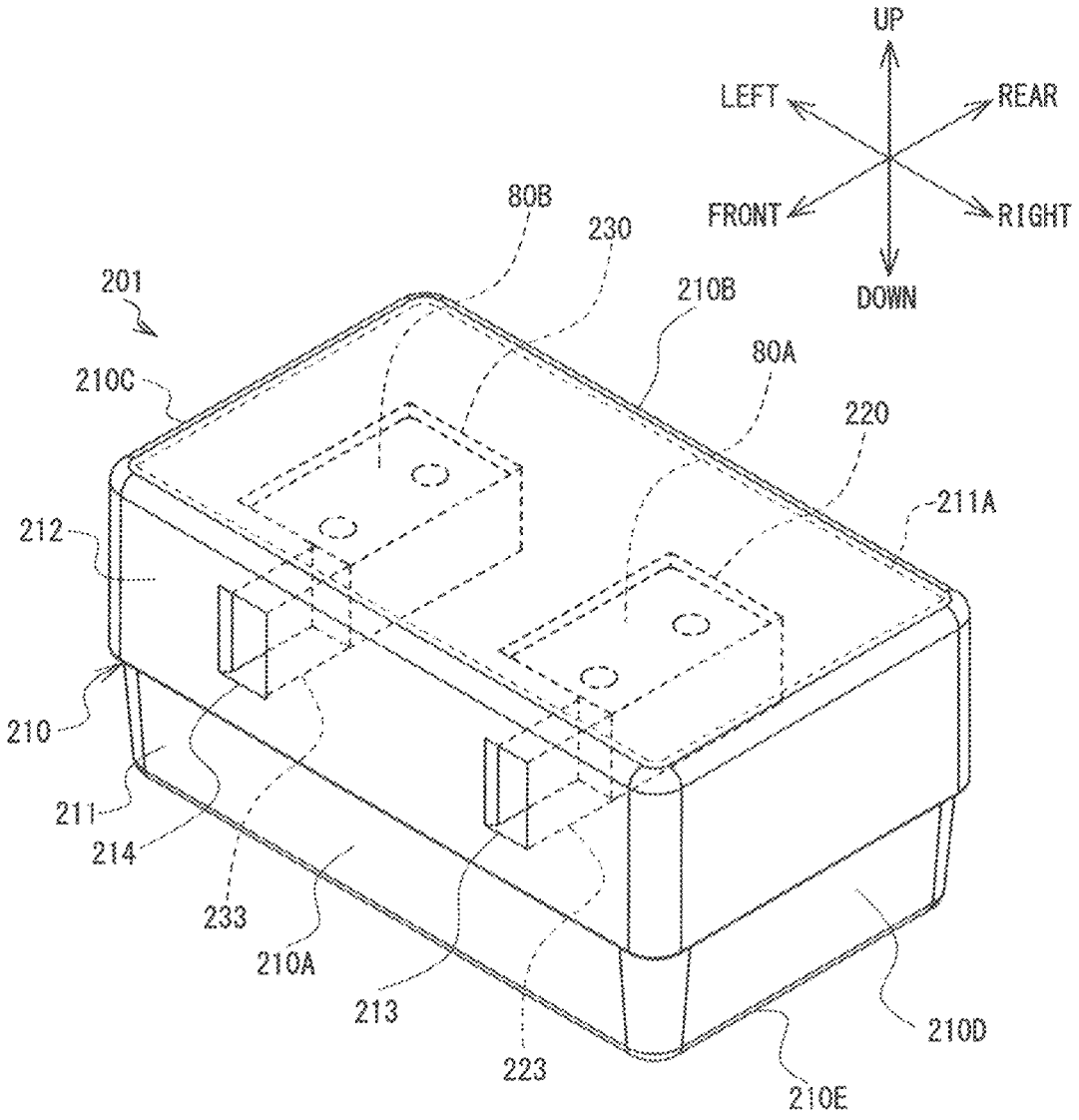
FIG. 11 is a perspective view of a print device as viewed from the upper right front side.
Figure 12:
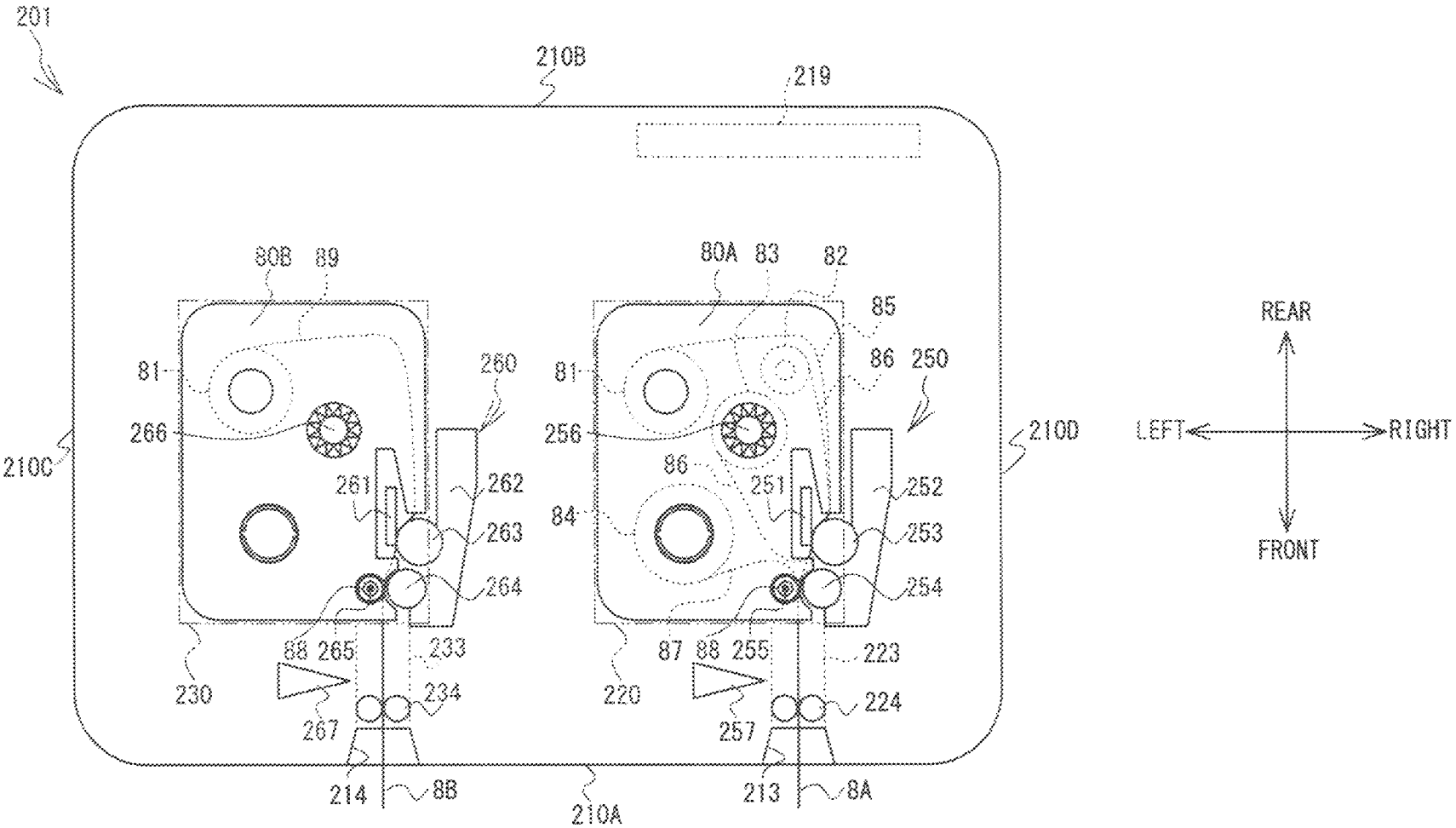
FIG. 12 is a plan view schematically showing an internal structure of the print device.

A third embodiment of the present disclosure will be described with reference to the drawings. A print device 201 according to the third embodiment will be described with reference to FIG. 11 and FIG. 12. In FIG. 11, tape cassettes 80A and 80B are schematically shown, and tape printing mechanisms 250 and 260 are omitted (this also applies to FIG. 13A, FIG. 15A and FIG. 15B, which will be described later). FIG. 12 shows a state in which the tape cassettes 80A and 80B are respectively mounted in tape mounting portions 220 and 230 (this also applies to FIG. 13B, FIG. 14A and FIG. 14B, which will be described later). In the description below, the upper side, the lower side, the lower right side, the upper left side, the upper right side and the lower left side of FIG. 11 are respectively defined as the upper side, the lower side, the right side, the left side, the rear side and the front side of the print device 201.

As shown in FIG. 11, the print device 201 is configured to print tapes 8A and 8B (refer to FIG. 12) using two printing mechanisms. The print device 201 is provided with a housing 210 that includes a main body case 211 and a cover 212. The housing 210 has a plurality of side surfaces, namely, a front surface 210A, a rear surface 210B, a left surface 210C and a right surface 210D. The housing 210 has a substantially horizontal bottom surface 210E. The front surface 210A and the rear surface 210B are side surfaces that face each other in the front-rear direction. The left surface 210C and the right surface 210D are side surfaces that face each other in the left-right direction.

The main body case 211 is a box-shaped member that is long in the left-right direction. The top surface of the main body case 211 is a substantially horizontal mounting surface 211A. The cover 212 is a member that is configured to be attached to and detached from an upper portion of the main body case 211. The cover 212 has a top surface that is long in the left-right direction in a plan view, and four side surfaces (a front surface, a rear surface, a left surface and a right surface) that extend downward from the periphery of the top surface. The cover 212 has an inside area that is surrounded by the top surface and the four side surfaces.

Tape discharge openings 213 and 214 are openings to respectively discharge the tapes 8A and 8B to the outside of the housing 210. The tape discharge opening 213 is provided in a right portion of the front surface of the cover 212, and has a rectangular shape that is long in the up-down direction. The tape discharge opening 214 is provided in a left portion of the front surface of the cover 212, and has a rectangular shape that is long in the up-down direction. The tapes 8A and 8B of the present example have the same length in the width direction (36 mm in the present example). Therefore, the tape discharge openings 213 and 214 have the same opening shape and the same length in the up-down direction.

When the cover 212 is mounted on the main body case 211 from above, the upper portion of the main body case 211 is housed in the inside area of the cover 212. At this time, the cover 212 covers the mounting surface 211A (refer to FIG. 11). The tape discharge openings 213 and 214 are disposed on the front side of an upper portion of the front surface of the main body case 211. In other words, the tape discharge openings 213 and 214 are respectively disposed in an upper right portion and an upper left portion of the front surface 210A. When the cover 212 is removed upward from the main body case 211, the mounting surface 211A is exposed upward.

The mounting surface 211A is provided with the tape mounting portions 220 and 230. The tape mounting portions 220 and 230 have a similar structure to the tape mounting portion 20 (refer to FIG. 3). The tape mounting portion 220 of the present example is provided in the center of a right portion of the mounting surface 211A. A feed path 223 extends continuously forward from a front right portion of the tape mounting portion 220. The tape mounting portion 230 of the present example is provided in the center of a left portion of the mounting surface 211A. A feed path 233 extends continuously forward from a front right portion of the tape mounting portion 230. Tape guides 224 and 234 (refer to FIG. 12) are respectively provided in the feed paths 223 and 233. Each of the tape guides 224 and 234 has a similar structure to the tape guide 24 (refer to FIG. 3), and determines the tape discharge direction of each of the tapes 8A and 8B to be the substantially horizontal and forward direction.

In a state in which the cover 212 is removed from the main body case 211, the user can attach and detach the tape cassettes 80A and 80B to and from the tape mounting portions 220 and 230, respectively, from above. When the cover 212 is mounted on the main body case 211, front end portions of the feed paths 223 and 233 respectively connect to the tape discharge openings 213 and 214.

A control board 219, a power source portion (not shown in the drawings) and the tape printing mechanisms 250 and 260 will be described with reference to FIG. 12. The control board 219 controls various operations of the print device 201 in the same manner as the control board 19 (refer to FIG. 4). The power source portion supplies power to the print device 201 in the same manner as the power source portion (not shown in the drawings) of the first embodiment. In the present example, the control board 219 is provided on a rear right portion inside the main body case 211, and extends in the up-down direction and the left-right direction. The power source portion is provided on the front side of the control board 219.

Since the tape printing mechanisms 250 and 260 are similar to the tape printing mechanism 50 (refer to FIG. 4), a brief description will be made. The tape printing mechanism 250 includes a print head 251, a platen holder 252, a platen roller 253, a movable feed roller 254, a tape drive shaft 255, a ribbon take-up shaft 256, a cutter 257, a first drive motor (not shown in the drawings), a cutter motor (not shown in the drawings), a second drive motor (not shown in the drawings) and the like. The print head 251, the tape drive shaft 255 and the ribbon take-up shaft 256 are each provided so as to stand upward from the bottom surface of the tape mounting portion 220. The print head 251 is provided on the front right portion of the tape mounting portion 220. The platen holder 252 is disposed on the right side of the tape mounting portion 220, and is configured to be displaced between an operating position and a retracted position in accordance with the attachment and detachment of the cover 212 (refer to FIG. 11). The cutter 257 is provided to the rear of the tape guide 224 in the feed path 223.

The tape printing mechanism 260 has the same structure as the tape printing mechanism 250, and includes a print head 261, a platen holder 262, a platen roller 263, a movable feed roller 264, a tape drive shaft 265, a ribbon take-up shaft 266, a cutter 267, a first drive motor (not shown in the drawings), a cutter motor (not shown in the drawings), a second drive motor (not shown in the drawings) and the like. The print head 261, the tape drive shaft 265 and the ribbon take-up shaft 266 are each provided so as to stand upward from the bottom surface of the tape mounting portion 230. The print head 261 is provided on the front right portion of the tape mounting portion 230. The platen holder 262 is disposed on the right side of the tape mounting portion 230, and is configured to be displaced between an operating position and a retracted position in accordance with the attachment and detachment of the cover 212. The cutter 267 is provided to the rear of the tape guide 234 in the feed path 233.

The tape cassettes 80A and 80B have the same outer shape as the tape cassette 80 (refer to FIG. 4), and are configured to be mounted in either of the tape mounting portions 220 and 230. In the description below, the tape cassette 80 that is mounted in the tape mounting portion 220 is referred to as the tape cassette 80A. The tape cassette 80 that is mounted in the tape mounting portion 230 is referred to as the tape cassette 80B. The tape cassette 80A of the present example is a laminate type tape cassette, and has the same structure as the tape cassette 80 shown in FIG. 4. On the other hand, the tape cassette 80B of the present example is a thermal type tape cassette in which a heat sensitive tape 89 is housed as the tape 8B. The first tape roll 81 is rotatably supported inside the tape cassette 80B. The first tape roll 81 is the unused heat sensitive tape 89 wound around a spool (not shown in the drawings).

The tape printing mechanisms 250 and 260 perform printing operations in accordance with control of the control board 219, in a similar manner to the first embodiment. Note, however, that the printing operations of the tape printing mechanisms 250 and 260 are different depending on the type of the tape cassette 80 that is mounted in each of the tape mounting portions 220 and 230.

In a similar manner to the first and second embodiments, the tape printing mechanism 250 performs the printing operations using the laminate type tape cassette 80A. More specifically, the print head 251 of the present example performs mirror image printing, and prints characters on the left surface of the film tape 85 that passes through the right side of the print head 251. The created tape 8A passes through the tape guide 224 in the feed path 223, and is discharged from the tape discharge opening 213 in a posture in which the width direction of the tape 8A is substantially parallel to the up-down direction. At this time, the tape 8A is discharged forward from the front surface 210A such that the print surface of the tape 8A is directed rightward. After the tape 8A is cut, the tape 8A falls into a first tape discharge area (not shown in the drawings) located on the front side of the housing 210.

The tape printing mechanism 260 performs the printing operations using the thermal type tape cassette 80B in the following manner. The first drive motor of the tape printing mechanism 260 rotates the tape drive roller 88 by rotating the tape drive shaft 265. In accordance with the rotation of the tape drive roller 88, the heat sensitive tape 89 is pulled out from the first tape roll 81. The heat sensitive tape 89 that has been pulled out is fed to a position between the print head 261 and the platen roller 263. The print head 261 thermally prints characters on the heat sensitive tape 89 as a normal image. The print head 261 of the present example prints the characters on the left surface of the heat sensitive tape 89 that passes through the right side of the print head 261. The printed heat sensitive tape 89 is fed to a position between the movable feed roller 264 and the tape drive roller 88. In this manner, the tape 8B, on which the characters have been printed on the heat sensitive tape 89, is created. In the created tape 8B, the characters appear on the print surface of the heat sensitive tape 89. The print surface of the heat sensitive tape 89 is the print surface of the tape 8B.

Further, the tape 8B passes through the inside of the feed path 233 and is fed forward as far as the tape guide 234. The second drive motor of the tape printing mechanism 260 drives and rotates the tape guide 234, and further feeds the tape 8B forward. The fed tape 8B passes through the tape guide 234, and is discharged from the discharge opening 214 in a posture in which the width direction of the tape 8B is substantially parallel to the up-down direction. At this time, the tape 8B is discharged forward from the front surface 210A such that the print surface of the tape 8B is directed leftward. In other words, the respective print surfaces of the discharged tapes 8A and 8B are directed in opposite directions such that they do not face each other. The cutter motor of the tape printing mechanism 260 drives the cutter 267, and cuts the tape 8B behind the tape guide 234. The cut tape 8B is caused to fly forward from the tape discharge opening 214 by a distance corresponding to a rotation speed of the tape guide 234, and falls into a second tape discharge area (not shown in the drawings) located on the front side of the housing 210.

In the example of the above-described print device 201, the tape guide 224 has the pair of discharge rollers 24A (refer to FIG. 3) that is configured to rotate around an axial line that is orthogonal to the bottom surface 210E, and the tape 8A is discharged to the outside by the rotation of the pair of discharge rollers 24A. Similarly, the tape guide 234 has the pair of discharge rollers 24A (refer to FIG. 3) that is configured to rotate around the axial line that is orthogonal to the bottom surface 210E, and the tape 8B is discharged to the outside by the rotation of the pair of discharge rollers 24A. In the tape guides 224 and 234, it is sufficient that the axial line of each of the discharge rollers 24A extends in a direction that intersects the bottom surface 210E.

In this manner, the tape guide 224 discharges the tape 8A to the outside of the housing 210 in a state in which the print surface of the tape 8A extends in a direction that intersects the bottom surface 210E. The tape guide 234 discharges the tape 8B to the outside in a state in which the print surface of the tape 8B extends in a direction that intersects the bottom surface 210E, and a virtual surface including the print surface of the tape 8B intersects a normal line with respect to the print surface of the tape 8A. In the present example, since the width of each of the print surfaces of the tapes 8A and 8B extends in the up-down direction, each of the print surfaces extends in a direction that substantially orthogonally intersects the bottom surface 210E that is substantially horizontal. The virtual surface including the print surface of the tape 8B extends in the front-rear direction and the up-down direction. The normal line with respect to the print surface of the tape 8A is a virtual line that extends in the left-right direction, and substantially orthogonally intersects the virtual surface including the print surface of the tape 8B.

The manufacturer can change the discharge direction of the tape 8A simply by adjusting the tape guide 224. The manufacturer can change the discharge direction of the tape 8B simply by adjusting the tape guide 234. For example, by changing the discharge direction of the tape 8A and the discharge direction of the tape 8B to directions that approach each other, the discharged tapes 8A and 8B are piled up in a common tape discharge area. In this case, the user can easily retrieve the printed tapes 8A and 8B. On the other hand, by changing the discharge direction of the tape 8A and the discharge direction of the tape 8B to directions that separate from each other, the discharged tapes 8A and 8B are piled up in tape discharge areas that are different from each other. In this case, it is possible to inhibit the printed tapes 8A and 8B from becoming mixed with each other.

When both the tape cassettes 80A and 80B are the laminate type, the print surfaces of the tapes 8A and 8B that are respectively discharged from the tape discharge openings 213 and 214 are directed in the same direction, namely, to the right. When both the tape cassettes 80A and 80B are the thermal type, the print surfaces of the tapes 8A and 8B that are respectively discharged from the tape discharge openings 213 and 214 are directed in the same direction, namely, to the left. When the tape cassette 80A is the thermal type and the tape cassette 80B is the laminate type, the respective print surfaces of the discharged tapes 8A and 8B are directed in opposite directions, such that they face each other.

3-2. Structural Description of Print Devices According to Modified Examples

The present disclosure is not limited the structure exemplified by the print device 201 (refer to FIG. 11 and FIG. 12), and various modifications are possible. Print devices 202 to 207 according to modified examples will be described with reference to FIG. 13A, FIG. 13B, FIG. 14A, FIG. 14B, FIG. 15A and FIG. 15B. In the description below, structural elements corresponding to those of the print device 201 are denoted by the same reference numerals and a description thereof will be omitted, and points that are different from the print device 201 will be mainly described.

Figure 13A:
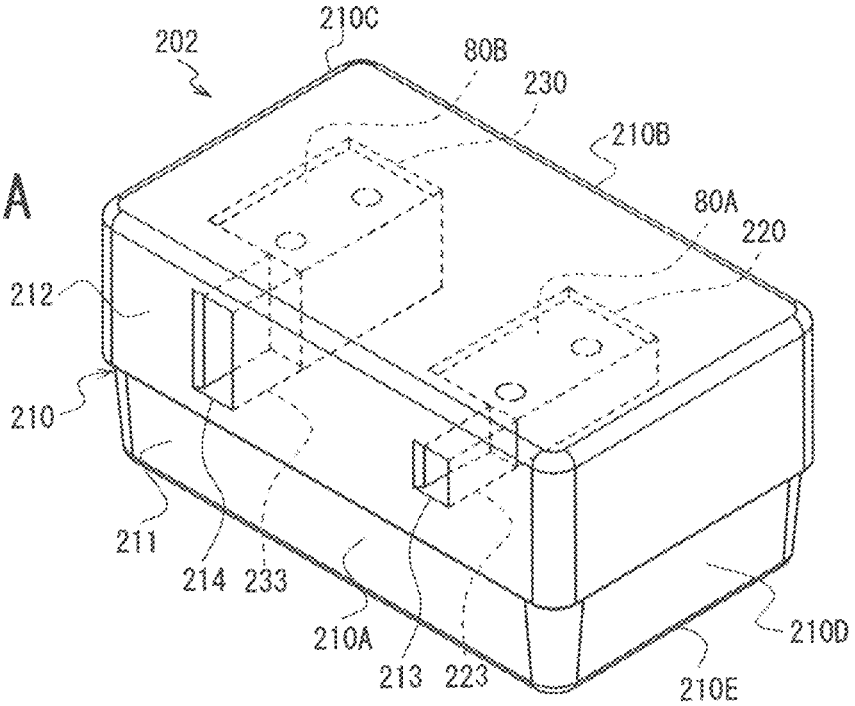
FIG. 13A is a perspective view of a print device as viewed from the upper right front side.

The print device 202 will be described with reference to FIG. 13A. The tapes 8A and 8B (refer to FIG. 12) of the present example have mutually different lengths in the width direction. As an example, the length in the width direction of the tape 8A is 24 mm, and the length in the width direction of the tape 8B is 48 mm. Therefore, the thickness (the length in the up-down direction) of the tape cassette 80B is larger than the thickness of the tape cassette 80A. The length in the up-down direction of the tape mounting portion 230 is larger than the length in the up-down direction of the tape mounting portion 220.

The main scanning direction of each of the tape printing mechanisms 250 and 260 (refer to FIG. 12) of the present example is substantially parallel to the up-down direction. The length in the main scanning direction of the tape printing mechanism 250 is at least equal to or more than the length in the width direction of the tape 8A. The length in the main scanning direction of the tape printing mechanism 260 is at least equal to or more than the length in the width direction of the tape 8B, and larger than the length in the main scanning direction of the tape printing mechanism 250. In comparison to the opening shape shown in FIG. 11, the length in the up-down direction of the tape discharge opening 213 is reduced corresponding to the tape width of 24 mm. In comparison to the opening shape shown in FIG. 11, the length in the up-down direction of the tape discharge opening 214 is increased corresponding to the tape width of 48 mm. Therefore, the length in the up-down direction of the tape discharge opening 214 is larger than the length in the up-down direction of the tape discharge opening 213. The other structural elements are the same as those of the print device 201. In the print device 202, similarly to the print device 201, the printed tapes 8A and 8B are respectively discharged via the tape discharge openings 213 and 214. Therefore, the print device 202 can respectively print the tapes 8A and 8B having mutually different lengths in the width direction.

When the tape width of the tape 8A is equal to or less than the length in the main scanning direction of the print head 251 (refer to FIG. 12), the tape printing mechanism 250 (refer to FIG. 12) can appropriately print the tape 8A. When the tape width of the tape 8B is equal to or less than the length in the main scanning direction of the print head 261 (refer to FIG. 12), the tape printing mechanism 260 (refer to FIG. 12) can appropriately print the tape 8B. Therefore, similarly to the print device 201, the print device 202 can also print each of the tapes 8A and 8B having mutually different lengths in the width direction. For example, when the tape cassette 80A is a tape cassette for a tape having a width of 24 mm, the tape printing mechanism 250 prints the tape 8A having the width of 24 mm. When the tape cassette 80B is a tape cassette for a tape having a width of 36 mm, the tape printing mechanism 260 prints the tape 8B having the width of 36 mm. This point also applies to the print devices 203 to 207 etc. that will be described later.

Figure 13B:
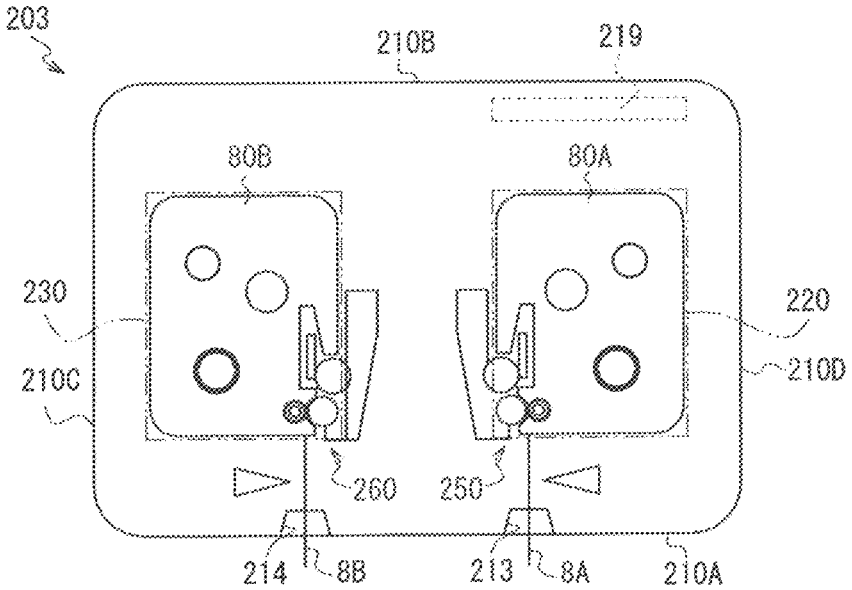
FIG. 13B is a plan view schematically showing an internal structure of a print device.

The print device 203 will be described with reference to FIG. 13B. In comparison to the arrangement of each of the tape mounting portion 220 and the tape printing mechanism 250 shown in FIG. 12, the tape mounting portion 220 and the tape printing mechanism 250 are left-right inverted with respect to a virtual line that extends in the front-rear direction and that passes through substantially the center of a right portion of the main body case 211 (refer to FIG. 11) in a plan view. The feed path 223 (refer to FIG. 11) extends forward from a front left portion of the tape mounting portion 220, and connects to the tape discharge opening 213. The other structural elements are the same as those of the print device 201.

In the print device 203, similarly to the print device 201, the printed tapes 8A and 8B are respectively discharged via the tape discharge openings 213 and 214. Note, however, that the print surface of the discharged laminate type tape 8A is directed to the left. The print surface of the discharged thermal type tape 8B is directed to the left. That is, the respective print surfaces of the tapes 8A and 8B are directed in the same direction. When both the tape cassettes 80A and 80B are the laminate type, the respective print surfaces of the discharged tapes 8A and 8B are directed in opposite directions such that they face each other. When both the tape cassettes 80A and 80B are the thermal type, the respective print surfaces of the discharged tapes 8A and 8B are directed in opposite directions such that they do not face each other. When the tape cassette 80A is the thermal type and the tape cassette 80B is the laminate type, the respective print surfaces of the discharged tapes 8A and 8B are directed in the same direction, namely, to the right.

Figure 14A:
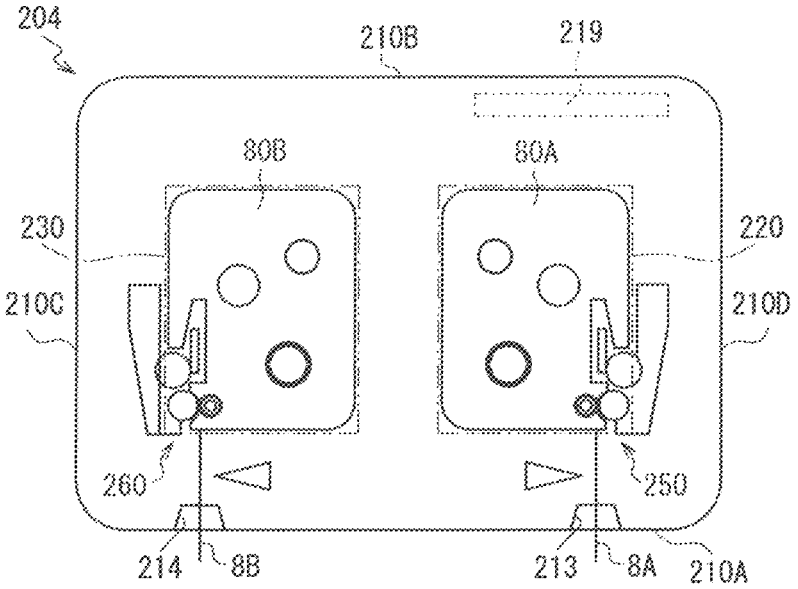
FIG. 14A and FIG. 14B are plan views respectively, schematically showing internal structures of print devices.

The print device 204 will be described with reference to FIG. 14A. In comparison to the arrangement of each of the tape mounting portion 230 and the tape printing mechanism 260 shown in FIG. 12, the tape mounting portion 230 and the tape printing mechanism 260 are left-right inverted with respect to a virtual line that extends in the front-rear direction and that passes through substantially the center of a left portion of the main body case 211 in a plan view. The feed path 233 (refer to FIG. 11) extends forward from a front left portion of the tape mounting portion 230, and connects to the tape discharge opening 214. The other structural elements are the same as those of the print device 201.

In the print device 204, similarly to the print device 201, the printed tapes 8A and 8B are respectively discharged via the tape discharge openings 213 and 214. Note, however, that the print surface of the discharged laminate type tape 8A is directed to the right. The print surface of the discharged thermal type tape 8B is directed to the right. That is, the respective print surfaces of the tapes 8A and 8B are directed in the same direction. When both the tape cassettes 80A and 80B are the laminate type, the respective print surfaces of the discharged tapes 8A and 8B are directed in opposite directions such that they do not face each other. When both the tape cassettes 80A and 80B are the thermal type, the respective print surfaces of the discharged tapes 8A and 8B are directed in opposite directions such that they face each other. When the tape cassette 80A is the thermal type and the tape cassette 80B is the laminate type, the respective print surfaces of the discharged tapes 8A and 8B are directed in the same direction, namely, to the left.

Figure 14B:
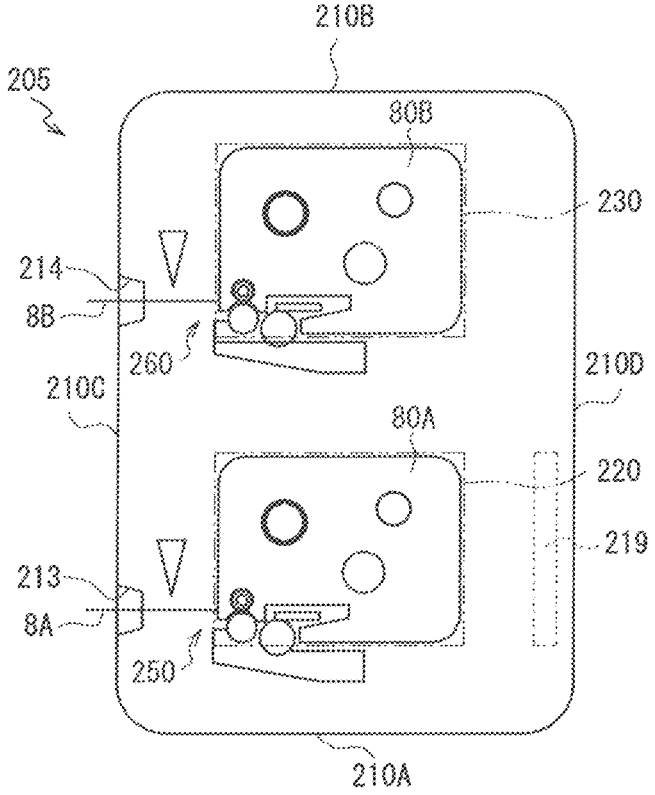

The print device 205 will be described with reference to FIG. 14B. In comparison to the arrangement of the print device 201 (refer to FIG. 11 and FIG. 12), the print device 205 is rotated clockwise by 90 degrees around the substantial center of the housing 210 (refer to FIG. 11) in a plan view. As a result, the housing 210 has a box shape that is long in the front-rear direction. The tape discharge opening 213 is provided in a front portion of the left surface 210C. The tape mounting portion 220 and the tape printing mechanism 250 are provided in a front portion of the main body case 211. The feed path 223 extends to the left from the front left portion of the tape mounting portion 220, and connects to the tape discharge opening 213. The tape discharge opening 214 is provided in a rear portion of the left surface 210C. The tape mounting portion 230 and the tape printing mechanism 260 are provided in a rear portion of the main body case 211. The feed path 233 extends to the left from the front left portion of the tape mounting portion 230, and connects to the tape discharge opening 214.

In the print device 205, the printed tapes 8A and 8B are respectively discharged leftward from the left surface 210C via the tape discharge openings 213 and 214. The print surface of the discharged laminate type tape 8A is directed forward. The print surface of the discharged thermal type tape 8B is directed rearward. That is, the respective print surfaces of the tapes 8A and 8B are directed in opposite directions such that they do not face each other. When both the tape cassettes 80A and 80B are the laminate type, the respective print surfaces of the discharged tapes 8A and 8B are directed in the same direction, namely, to the front. When the tape cassette 80A is the thermal type and the tape cassette 80B is the laminate type, the respective print surfaces of the discharged tapes 8A and 8B are directed in opposite directions such that they face each other.

Figure 15A:
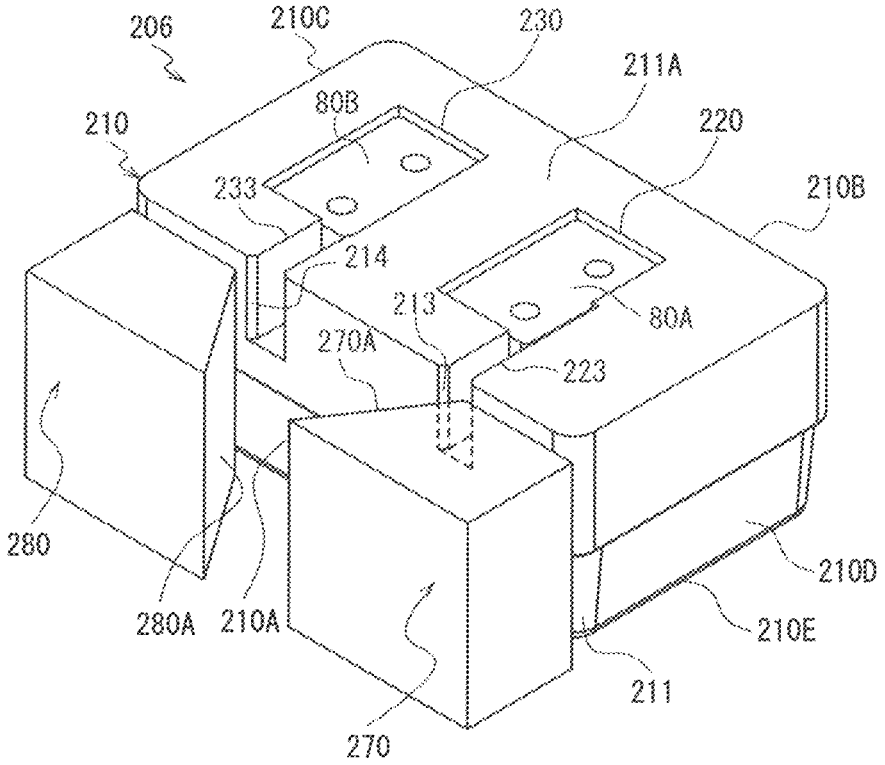
FIG. 15A and FIG. 15B are perspective views of print devices, respectively, as viewed from the upper right front side.

The print device 206 will be described with reference to FIG. 15A. The housing 210 of the present example is provided with a cover (not shown in the drawings) and the main body case 211. In the same manner as the structure shown in FIG. 11, the tape mounting portions 220 and 230 are provided in the mounting surface 211A. The tape discharge openings 213 and 214 of the present example are respectively provided in a right portion and a left portion of the front surface of the main body case 211. The feed path 223 extends forward from the tape mounting portion 220, and connects to the tape discharge opening 213. The feed path 233 extends forward from the tape mounting portion 230, and connects to the tape discharge opening 214.

The cover (not shown in the drawings) is provided on the upper side of the main body case 211, and is a plate-shaped member that is configured to open and close the mounting surface 211A. In the same manner as the structure shown in FIG. 12, the tape printing mechanisms 250 and 260 are provided inside the main body case 211. When the cover is opened, the platen holders 252 and 262 (refer to FIG. 12) are displaced to their retracted positions. When the cover is closed, the platen holders 252 and 262 are displaced to their operating positions.

The print device 206 is provided with guide members 270 and 280. The guide members 270 and 280 are provided on the front surface 210A, and have a substantially cuboid shape that is long in the up-down direction. The guide member 270 is disposed on the right side of the tape discharge opening 213 in a front view, and has a guide surface 270A. The guide surface 270A is a vertical plane that extends leftward and forward from the vicinity of a right end portion of the tape discharge opening 213. The guide member 280 is disposed on the left side of the tape discharge opening 214 in the front view, and has a guide surface 280A. The guide surface 280A is a vertical plane that extends rightward and forward from the vicinity of a left end portion of the tape discharge opening 214. The other structural elements are the same as those of the print device 201.

The tape guide 224 (refer to FIG. 12) discharges the printed tape 8A forward from the tape discharge opening 213. The discharged tape 8A is guided leftward and forward along the guide surface 270A. After the tape 8A is cut, the tape 8A falls into a tape discharge area (not shown in the drawings) located in front of the center of the housing 210. The tape guide 234 (refer to FIG. 12) discharges the printed tape 8B forward from the tape discharge opening 214. The discharged tape 8B is guided rightward and forward along the guide surface 280A. After the tape 8B is cut, the tape 8B falls into the tape discharge area (not shown in the drawings) in the same manner as the tape 8A.

In this manner, the printed tapes 8A and 8B are respectively guided along the guide surfaces 270A and 280A, and are piled up in the common tape discharge area. Therefore, it is easy for the user to retrieve the printed tapes 8A and 8B. It is preferable that the tape discharge area be located between the guide members 270 and 280. It is thus possible to reliably inhibit the printed tapes 8A and 8B from being dispersed outside the housing 210.

Figure 15B:
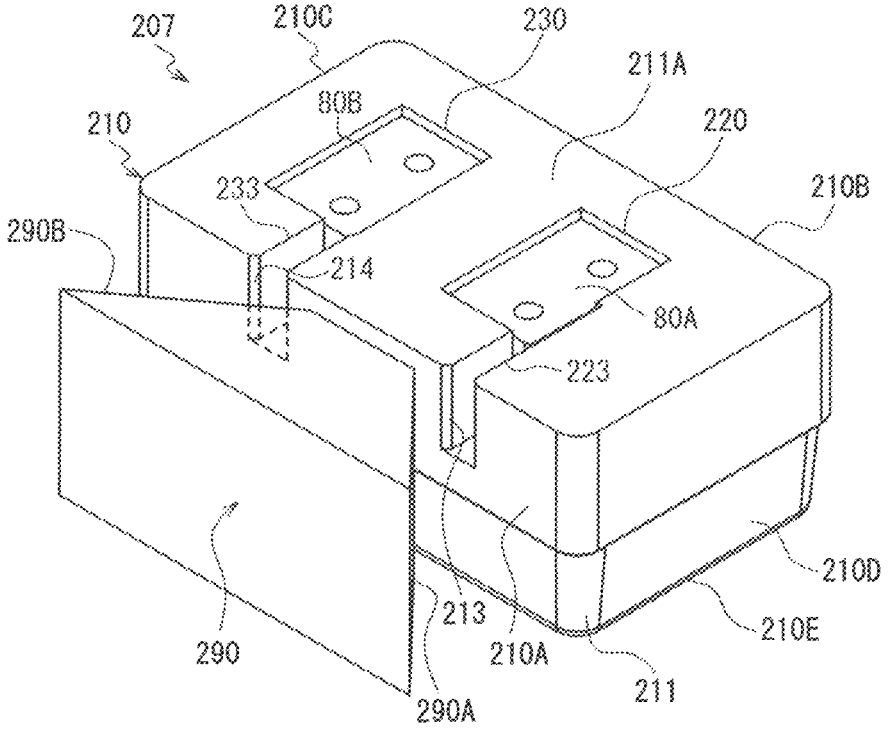

The print device 207 will be described with reference to FIG. 15B. In comparison to the print device 206 (refer to FIG. 15A), the print device 207 is different in the following points. The print device 207 is provided with a guide member 290 in place of the guide members 270 and 280 (refer to FIG. 15A). The guide member 290 is provided on the front surface 210A, and has a substantially cuboid shape that is long in the up-down direction. The guide member 290 is disposed between the tape discharge openings 213 and 214 in a front view. The guide member 290 has guide surfaces 290A and 290B. The guide surface 290A is a vertical plane that extends rightward and forward from the vicinity of a left end portion of the tape discharge opening 213. The guide surface 290B is a vertical plane that extends leftward and forward from the vicinity of a right end portion of the tape discharge opening 214. The other structural elements are the same as those of the print device 206.

The tape guide 224 (refer to FIG. 12) discharges the printed tape 8A forward from the tape discharge opening 213. The discharged tape 8A is guided rightward and forward along the guide surface 290A. After the tape 8A is cut, the tape 8A falls into a first tape discharge area (not shown in the drawings) located on the right side or to the front right of the guide member 290. The tape guide 234 (refer to FIG. 12) discharges the printed tape 8B forward from the tape discharge opening 214. The discharged tape 8B is guided leftward and forward along the guide surface 290B. After the tape 8B is cut, the tape 8B falls into a second tape discharge area located on the left side or to the front left of the guide member 290.

In this manner, the printed tape 8A is guided into the first tape discharge area along the guide surface 290A. It is thus possible to inhibit the printed tape 8A from being dispersed outside the housing 210. The printed tape 8B is guided into the second tape discharge area along the guide surface 290B. It is thus possible to inhibit the printed tape 8B from being dispersed outside the housing 210. It is thus possible to inhibit the printed tapes 8A and 8B from becoming mixed outside the housing 210.

It is preferable that the first tape discharge area and the second tape discharge area be located on either side of the guide member 290. It is thus possible to reliably inhibit the printed tapes 8A and 8B from becoming mixed outside the housing 210. In this case, the guide surface 290A may be a vertical plane that extends forward, or leftward and forward, from the vicinity of the left end portion of the tape discharge opening 213. The guide surface 290B may be a vertical plane that extends forward, or rightward and forward, from the vicinity of the right end portion of the tape discharge opening 214. That is, the shape and size of the guide member 290 can be changed as long as the guide member 290 can be disposed between the first tape discharge area and the second tape discharge area.

3-3. Examples of Functions According to Third Embodiment

Functions according to the third embodiment will be exemplified.

(3-3-1) A print device is provided with a first print portion, a first discharge portion, a second print portion, and a second discharge portion. The first print portion is configured to print on a first surface, which is a surface of a first medium. The first discharge portion is configured to discharge the first medium whose first surface has been printed by the first print portion to the outside of the print device. The second print portion is configured to print on a second surface, which is a surface of a second medium. The second discharge portion is configured to discharge the second medium whose second surface has been printed by the second print portion to the outside of the print device. The first discharge portion has a first discharge roller configured to rotate around an axial line that extends in a direction that intersects a bottom surface. The first discharge portion is configured to discharge the first medium to the outside of the print device by the rotation of the first discharge roller. The second discharge portion has a second discharge roller configured to rotate around an axial line that extends in a direction that intersects the bottom surface. The second discharge portion is configured to discharge the second medium to the outside of the print device By the rotation of the second discharge roller.

According to this, the first medium and the second medium are discharged from the print device such that their print surfaces intersect the bottom surface and at least in a posture in which they are not orthogonal to each other. Thus, simply by adjusting at least one of the first discharge portion and the second discharge portion, it may be possible to easily change the directions in which the first medium and the second medium are respectively discharged. Therefore, it may be possible to easily change the directions in which the print media are respectively discharged from the two printing mechanisms, without increasing the size of the print device.

(3-3-2) In the print device, the first discharge portion and the second discharge portion are configured to respectively discharge the first medium and the second medium from a front surface of the print device.

According to this, for example, a user on the front surface side of the print device may easily retrieve the first medium and the second medium that have been printed. Therefore, the operability of the print device may be increased.

(3-3-3) In the print device, each of the first medium and the second medium is a tape that is a strip-shaped print medium.

According to this, two tapes may be respectively printed by different printing mechanisms. For example, since the two tapes may be printed simultaneously, usability of the print device may be improved.

(3-3-4) In the print device, the length in a main scanning direction of the first print portion and the length in a main scanning direction of the second print portion are different from each other.

According to this, two tapes having different tape widths may be respectively printed by different printing mechanisms. For example, since the two tapes having different tape widths may be printed simultaneously, the usability of the print device may be improved.

(3-3-5) In the print device, the first medium is a tape that is a strip-shaped print medium on which printing is performed using an ink ribbon. The second medium is a roll of paper that is a strip-shaped print medium on which thermal printing is performed.

According to this, two tapes used in different printing methods may be respectively printed by different printing mechanisms. For example, since the two tapes used in the different printing methods may be printed simultaneously, the usability of the print device may be improved.

(3-3-6) In the print device, the first discharge portion and the second discharge portion are configured to respectively discharge the first medium and the second medium from a left side surface of the print device.

According to this, for example, the user on the front surface side of the print device may easily retrieve the first print medium and the second print medium that have been printed. Therefore, operability of the print device may be improved.

(3-3-7) In the print device, the first discharge portion is configured to discharge the first medium to the outside of the print device in a state in which the first surface faces a predetermined direction. The second discharge portion is configured to discharge the second medium to the outside of the print device in a state in which the second surface faces the predetermined direction.

According to this, the first medium and the second medium that have been printed are discharged such that the first surface and the second surface are directed in the same direction. Since the user may visually check the first surface and the second surface simultaneously from the same side, the operability of the print device may be improved.

(3-3-8) In the print device, the first discharge portion is configured to discharge the first medium to the outside of the print device, in a state in which the first surface faces a predetermined direction. The second discharge portion is disposed on the predetermined direction side of the first discharge portion. The second discharge portion is configured to discharge the second medium to the outside of the print device in a state in which the second surface faces a direction opposite to the predetermined direction.

According to this, the first medium and the second medium that have been printed are discharged such that the first surface and the second surface are directed in the opposite directions. For example, when the first surface and the second surface face each other, the user may visually check the first surface and the second surface simultaneously, from a position between the first medium and the second medium that have been printed.

(3-3-9) The print device is provided with a main body portion and a cover. A first mounting portion and a second mounting portion are disposed in the main body portion. The first mounting portion is configured such that the first medium is detachably mounted in the first mounting portion. The second mounting portion is configured such that the second medium is detachably mounted in the second mounting portion. The cover is configured to be displaced between a position in which the cover open a top surface of the main body portion and a position in which the cover close the top surface of the main body portion. The first mounting portion and the second mounting portion have attaching openings via which the first medium and the second medium are respectively attachable and detachable from above in a state in which the top surface of the main body portion is opened by the cover.

According to this, in a state in which the cover is opened, the first medium and the second medium may be respectively attached to and detached from the first mounting portion and the second mounting portion from above. Therefore, the operability of the print device may be improved.

(3-3-10) The print device is provided with a first print portion, a first discharge portion, a second print portion, and a second discharge portion. The first print portion is configured to print on a first surface, which is a surface of a first medium. The first discharge portion is configured to discharge the first medium whose first surface has been printed by the first print portion to the outside of the print device. The second print portion is configured to print on a second surface, which is a surface of a second medium. The second discharge portion is configured to discharge the second medium whose second surface has been printed by the second print portion to the outside of the print device. The first discharge portion is configured to discharge the first medium to the outside of the print device in a state in which a virtual plane including the first surface intersects a bottom surface of the print device. The second discharge portion is configured to discharge the second medium to the outside of the print device in a state in which a virtual plane including the second surface intersects the bottom surface and a normal line with respect to the first surface.

According to this, the first medium and the second medium are discharged from the print device such that their print surfaces intersect the bottom surface and at least in a posture in which they are not orthogonal to each other. Thus, simply by adjusting at least one of the first discharge portion and the second discharge portion, it may be possible to easily change the directions in which the first medium and the second medium are respectively discharged. Therefore, it may be possible to easily change the directions in which the print media are respectively discharged from the two printing mechanisms, without increasing the size of the print device.

4. Remarks

A print device according to another modified example may be structured by appropriately combining the features of each of the print devices disclosed in the first to third embodiments. For example, in either of the print devices 102 and 103 (refer to FIG. 10A and FIG. 10B), a new tape mounting portion and a new tape printing mechanism may be provided below the user interface portion 117, in place of the ribbon mounting portion 130, the tube mounting portion 140 and the tube printing mechanism 160. In this case, it is preferable that the length in the main scanning direction of the new tape printing mechanism be shorter than the length in the main scanning direction of the tape printing mechanism 150. Thus, while suppressing an increase in size of the print device, two tapes that are different in at least one of the tape width and the printing method can be respectively printed by the two printing mechanisms.

In either of the print devices 101 and 102 (refer to FIG. 9 and FIG. 10A), the guide members 270 and 280 (refer to FIG. 15A) may be provided adjacent to the tape discharge opening 114 and the tube discharge opening 116, respectively. In either of the print devices 101 and 102 (refer to FIG. 9 and FIG. 10A), the guide member 290 (refer to FIG. 15B) may be provided between the tape discharge opening 114 and the tube discharge opening 116. It is thus possible to freely adjust the areas into which the tape and the tube are respectively discharged.

Figure 16:
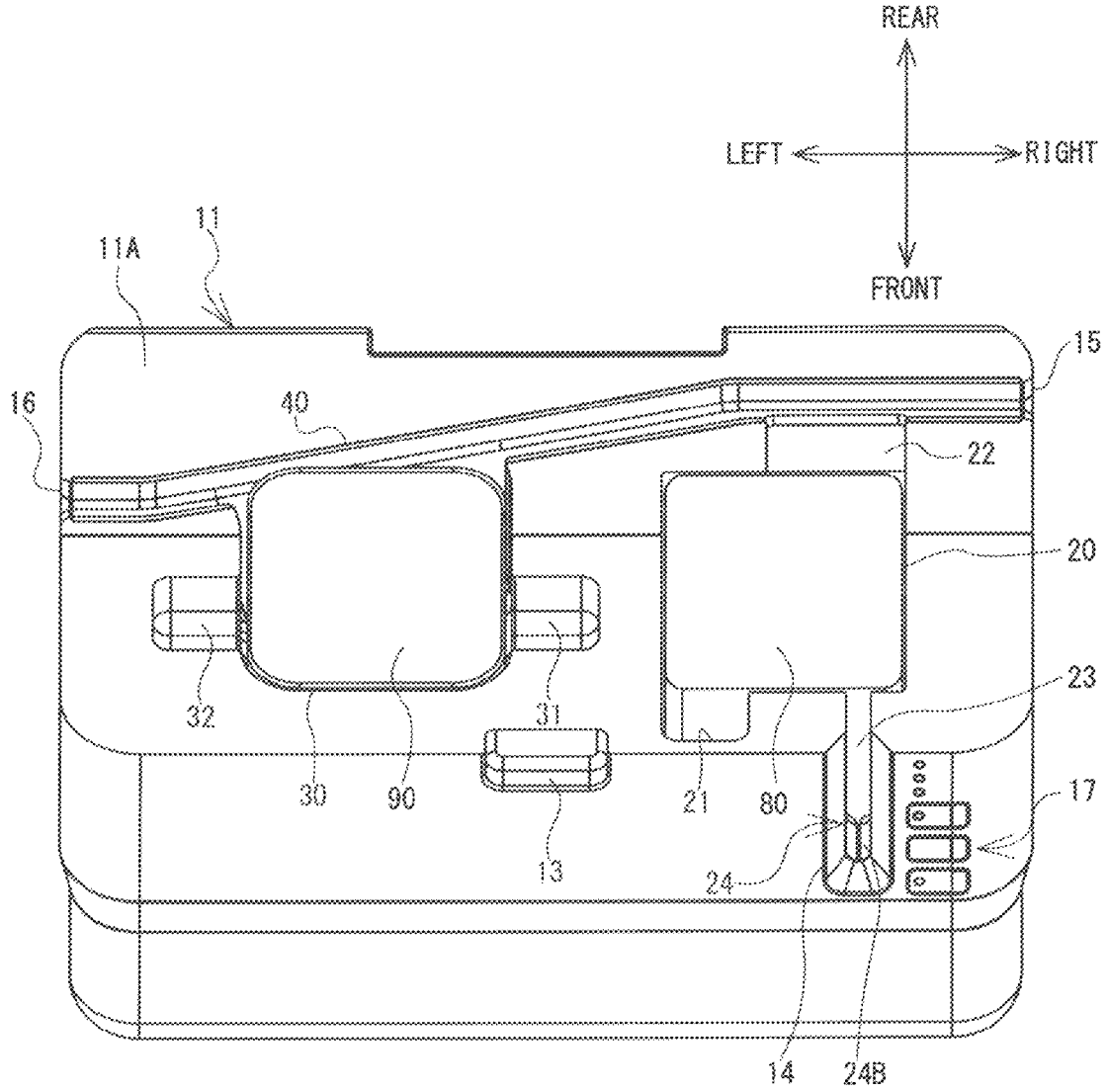
FIG. 16 is a perspective view of the main body case according to a modified example, as viewed from the upper front side.

The tape guide 24 is not limited to a guide having the pair of discharge rollers 24A (this also applies to the tape guides 124, 224 and 234). For example, the tape guide 24 shown in FIG. 16 has a pair of guide plates 24B that are disposed so as to face each other in the left-right direction. A gap through which the tape 8 (refer to FIG. 2) can pass is formed between the pair of guide plates 24B. In this case, the tape discharge direction is determined by the arrangement and angle of the pair of guide plates 24B. In the present example, since the gap between the pair of guide plates 24B extends forward and substantially horizontally, the tape discharge direction is also the substantially horizontal and forward direction. The user can manually adjust at least one of the arrangement and the angle of the pair of guide plates 24B. Therefore, the user can freely change the tape discharge direction by adjusting the pair of guide plates 24B.

The tape guide 24 may have the single discharge roller 24A. In this case, the discharge roller 24A may feed the tape 8 by rotating while the tape 8 is clamped between it and a side wall of the feed path 23. The tape guide 24 may have the single guide plate 24B. In this case, the guide plate 24B may guide the tape 8 between it and the side wall of the feed path 23. A guide member (for example, a discharge roller, a guide plate or the like) to discharge the tube 9 may be provided in the vicinity of each of the tube discharge openings 16 and 116.

It is needless to mention that the various functions disclosed in the first to third embodiments also apply to other print devices having at least one of the structures that provides at least one of the various functions. For example, the print device 103 has the structures and functions similar to those described in (1-3-1). Also in another print device, if the tape discharge direction is changed by adjusting the tape guide, it may be possible to provide functions similar to those described in (1-3-1).

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a tape mounting portion configured such that a tape is detachably mounted in the tape mounting portion, the tape being a strip-shaped print medium;

a tape print portion configured to print on the tape mounted in the tape mounting portion;

a tape discharge portion configured to discharge the tape printed by the tape print portion to the outside of the print device;

a tube mounting portion configured such that a tube is detachably mounted in the tube mounting portion along a predetermined direction, the tube being a cylindrical print medium;

a ribbon mounting portion configured such that an ink ribbon is detachably mounted in the ribbon mounting portion;

a tube print portion configured to print on the tube mounted in the tube mounting portion by using the ink ribbon mounted in the ribbon mounting portion; and a tube discharge portion configured to discharge the tube printed by the tube print portion to the outside of the print device, wherein the tape mounting portion and the ribbon mounting portion are disposed on a same side with respect to the tube mounting portion, and are disposed side by side along the predetermined direction.

2. The print device according to claim 1, further comprising:

a plurality of surfaces, the plurality of surfaces including a first surface, a second surface and a third surface, the second surface and the third surface being disposed on both end sides of the first surface such that the second surface and the third surface face each other, wherein at least a part of the tape mounting portion and at least a part of the ribbon mounting portion are disposed side by side in a direction in which the second surface and the third surface face each other.

3. The print device according to claim 2, further comprising:

a tube supply portion disposed at an end portion on an upstream side in the predetermined direction of the tube mounting portion, the tube supply portion including an opening configured to guide the tube to the inside of the print device, wherein the tube print portion is configured to print on the tube mounted in the tube mounting portion while feeding the tube mounted in the tube mounting portion in the predetermined direction, and the tube supply portion is disposed in the second surface.

4. The print device according to claim 2, further comprising:

a tube supply portion disposed at an end portion on an upstream side in the predetermined direction of the tube mounting portion, the tube supply portion including an opening configured to guide the tube to the inside of the print device, wherein the plurality of surfaces include a fourth surface that is a surface opposite to the first surface, the tube print portion is configured to print on the tube mounted in the tube mounting portion while feeding the tube mounted in the tube mounting portion in the predetermined direction, and the tube supply portion is disposed in the fourth surface.

5. The print device according to claim 2, wherein the tube print portion is configured to print on the tube mounted in the tube mounting portion while feeding the tube mounted in the tube mounting portion in the predetermined direction, and the tube discharge portion is disposed in the third surface, at an end portion on a downstream side in the predetermined direction of the tube mounting portion, the tube discharge portion including an opening configured to guide the tube to the outside of the print device.

6. The print device according to claim 2, further comprising:

a tube supply portion disposed at an end portion on an upstream side in the predetermined direction of the tube mounting portion, the tube supply portion including an opening configured to guide the tube to the inside of the print device, wherein the tube print portion is configured to print on the tube mounted in the tube mounting portion while feeding the tube mounted in the tube mounting portion in the predetermined direction, the tube discharge portion is disposed at an end portion on a downstream side in the predetermined direction of the tube mounting portion, the tube discharge portion including an opening configured to guide the tube to the outside of the print device, the tube supply portion and the tube discharge portion are disposed in surfaces that are different from each other among the plurality of surfaces, and the tape discharge portion is configured to discharge the tape printed by the tape print portion, from one of the plurality of surfaces that is other than the surface in which the tube supply portion is disposed and the surface in which the tube discharge portion is disposed.

7. The print device according to claim 2, further comprising:

a tube supply portion disposed at an end portion on an upstream side in the predetermined direction of the tube mounting portion, the tube supply portion including an opening configured to guide the tube to the inside of the print device, wherein the tube print portion is configured to print on the tube mounted in the tube mounting portion while feeding the tube mounted in the tube mounting portion in the predetermined direction, the tube discharge portion is disposed at an end portion on a downstream side in the predetermined direction of the tube mounting portion, the tube discharge portion including an opening configured to guide the tube to the outside of the print device, the tube supply portion is disposed in the second surface, and the tube discharge portion is disposed in the third surface, and is disposed on the first surface side relative to the tube supply portion.

8. The print device according to claim 1, further comprising:

a main body portion in which the tape mounting portion, the tube mounting portion and the ribbon mounting portion are disposed; and a cover configured to be displaced between a position in which the cover open a top surface of the main body portion and a position in which the cover close the top surface of the main body portion, wherein the tape mounting portion, the tube mounting portion and the ribbon mounting portion have attaching openings via which the tape, the tube and the ink ribbon are respectively attachable and detachable from above in a state in which the top surface of the main body portion is opened by the cover.

9. The print device according to claim 2, further comprising:

a main body portion in which the tape mounting portion, the tube mounting portion and the ribbon mounting portion are disposed; and a cover configured to be displaced between a position in which the cover open a top surface of the main body portion and a position in which the cover close the top surface of the main body portion, wherein the tape mounting portion, the tube mounting portion and the ribbon mounting portion have attaching openings via which the tape, the tube and the ink ribbon are respectively attachable and detachable from above in a state in which the top surface of the main body portion is opened by the cover.

10. The print device according to claim 3, further comprising:

a main body portion in which the tape mounting portion, the tube mounting portion and the ribbon mounting portion are disposed; and a cover configured to be displaced between a position in which the cover open a top surface of the main body portion and a position in which the cover close the top surface of the main body portion, wherein the tape mounting portion, the tube mounting portion and the ribbon mounting portion have attaching openings via which the tape, the tube and the ink ribbon are respectively attachable and detachable from above in a state in which the top surface of the main body portion is opened by the cover.

11. The print device according to claim 4, further comprising:

a main body portion in which the tape mounting portion, the tube mounting portion and the ribbon mounting portion are disposed; and a cover configured to be displaced between a position in which the cover open a top surface of the main body portion and a position in which the cover close the top surface of the main body portion, wherein the tape mounting portion, the tube mounting portion and the ribbon mounting portion have attaching openings via which the tape, the tube and the ink ribbon are respectively attachable and detachable from above in a state in which the top surface of the main body portion is opened by the cover.

12. The print device according to claim 5, further comprising:

a main body portion in which the tape mounting portion, the tube mounting portion and the ribbon mounting portion are disposed; and a cover configured to be displaced between a position in which the cover open a top surface of the main body portion and a position in which the cover close the top surface of the main body portion, wherein the tape mounting portion, the tube mounting portion and the ribbon mounting portion have attaching openings via which the tape, the tube and the ink ribbon are respectively attachable and detachable from above in a state in which the top surface of the main body portion is opened by the cover.

13. The print device according to claim 6, further comprising:

a main body portion in which the tape mounting portion, the tube mounting portion and the ribbon mounting portion are disposed; and a cover configured to be displaced between a position in which the cover open a top surface of the main body portion and a position in which the cover close the top surface of the main body portion, wherein the tape mounting portion, the tube mounting portion and the ribbon mounting portion have attaching openings via which the tape, the tube and the ink ribbon are respectively attachable and detachable from above in a state in which the top surface of the main body portion is opened by the cover.

14. The print device according to claim 7, further comprising:

a main body portion in which the tape mounting portion, the tube mounting portion and the ribbon mounting portion are disposed; and a cover configured to be displaced between a position in which the cover open a top surface of the main body portion and a position in which the cover close the top surface of the main body portion, wherein the tape mounting portion, the tube mounting portion and the ribbon mounting portion have attaching openings via which the tape, the tube and the ink ribbon are respectively attachable and detachable from above in a state in which the top surface of the main body portion is opened by the cover.

* * * * *